US011150601B2

(12) United States Patent
Mizuno et al.

(10) Patent No.: US 11,150,601 B2
(45) Date of Patent: Oct. 19, 2021

(54) MOVING UNIT AND IMAGE FORMING APPARATUS

(71) Applicant: CANON KABUSHIKI KAISHA, Tokyo (JP)

(72) Inventors: Tatsubumi Mizuno, Atsugi (JP); Joji Goto, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/937,320

(22) Filed: Jul. 23, 2020

(65) Prior Publication Data

US 2021/0034008 A1 Feb. 4, 2021

(30) Foreign Application Priority Data

Jul. 30, 2019 (JP) ..... JP2019-140188

(51) Int. Cl.
*G03G 21/10* (2006.01)
*G03G 21/16* (2006.01)

(52) U.S. Cl.
CPC ..... *G03G 21/169* (2013.01); *G03G 21/105* (2013.01); *G03G 21/1633* (2013.01); *G03G 21/1647* (2013.01); *G03G 2221/1618* (2013.01); *G03G 2221/1684* (2013.01); *G03G 2221/1869* (2013.01)

(58) Field of Classification Search
CPC ..... G03G 15/0886; G03G 21/105; G03G 21/1633; G03G 21/1647; G03G 21/169; G03G 2215/0692; G03G 2221/1618; G03G 2221/1869; G03G 15/0872; G03G 21/1623; G03G 2221/1684
See application file for complete search history.

(56) References Cited

U.S. PATENT DOCUMENTS

2011/0076056 A1* 3/2011 Sato ..... G03G 15/0886 399/120
2016/0033927 A1* 2/2016 Sato ..... G03G 21/105 399/110
2017/0269539 A1* 9/2017 Komiyama ..... G03G 21/105
(Continued)

FOREIGN PATENT DOCUMENTS

JP 5-303311 A 11/1993
JP 9-166949 A 6/1997
(Continued)

*Primary Examiner* — Sophia S Chen
(74) *Attorney, Agent, or Firm* — Canon U.S.A., Inc. IP Division

(57) ABSTRACT

In a moving unit, a shutter member is provided with a first contact portion configured to receive a force in a predetermined direction when the shutter member comes into contact with the apparatus main body, and a second contact portion configured to receive a force in a direction different from the predetermined direction when the shutter member comes into contact with the apparatus main body. When the moving unit is moved from the second position to the first position along the first direction, the first and second contact portions sequentially come into contact with the apparatus main body, the shutter member moves relative to the delivery member in the order of a second direction intersecting the first direction, and the first direction, and the opening changes from the closed state to the open state.

14 Claims, 21 Drawing Sheets

(56) References Cited

U.S. PATENT DOCUMENTS

| | | | | |
|---|---|---|---|---|
| 2017/0285567 | A1* | 10/2017 | Fukaya | G03G 21/1821 |
| 2019/0265642 | A1* | 8/2019 | Sahara | G03G 21/105 |
| 2020/0073315 | A1* | 3/2020 | Sato | G03G 21/105 |

FOREIGN PATENT DOCUMENTS

| | | | |
|---|---|---|---|
| JP | 2002-014542 | A | 1/2002 |
| JP | 2011-145482 | A | 7/2011 |

* cited by examiner

MOVING UNIT AND IMAGE FORMING APPARATUS

BACKGROUND

Field

The present disclosure relates to an image forming apparatus and a moving unit used in the image forming apparatus. More particularly, the present invention relates to an electrophotographic image forming apparatus for forming an image on a recording material by using an electrophotographic process, and to a moving unit used in the electrophotographic image forming apparatus.

Description of the Related Art

In a conventional electrophotographic image forming apparatus, part of toner of a toner image formed on a photosensitive drum or a transfer belt may remain on the photosensitive drum and the transfer belt even after completion of the transfer process. Japanese Patent Application Laid-Open No. 5-303311 discusses a technique for removing "residual transfer toner" from the surfaces of a photosensitive drum and a transfer belt by using a cleaning mechanism in order to collect residual transfer toner. Residual transfer toner is discharged, through a waste toner pipe, into a waste toner container disposed in the main body of an image forming apparatus.

In a configuration discussed in Japanese Patent Application Laid-Open No. 5-303311, a cylindrical shutter member is provided to open and close the discharge port of the waste toner pipe. When the waste toner pipe and the waste toner container are connected to each other, the waste toner container is axially moved relative to the waste toner pipe to be in contact with the waste toner pipe. Then, the waste toner container is moved from the position where the shutter member of the waste toner pipe is "locked" to the position where the shutter member is movable. Then, the shutter member is further moved by operating a moving unit disposed in the apparatus main body, and the opening of the waste toner pipe is changed from the closed state to the open state.

More specifically, in the configuration discussed in Japanese Patent Application Laid-Open No. 5-303311, the operation to change the opening of the waste toner pipe from the closed state to the opened state is inhibited unless the "locked" state of the shutter member is canceled. This prevents the opening window from being opened even if the user improperly touches the shutter member, thus avoiding the problem of leakage of waste toner.

However, when the waste toner container is set and used in the configuration discussed in Japanese Patent Application Laid-Open No. 5-303311, another (second) moving means (moving operation) for moving the shutter member from the "closed position" to the "opened position" is required in addition to the operation to attach the waste toner container to the waste toner pipe. This tends to increase the complexity in the configuration and operation of the apparatus.

SUMMARY

The present disclosure is directed to a moving unit and an image forming apparatus which can prevent a shutter member from being opened in an improper operation, and can open the shutter member using a simple configuration when the moving unit is attached to the apparatus main body.

A moving unit according to the present disclosure includes a delivery member provided with an opening and configured to deliver a developer through the opening, and a shutter member engages with the delivery member to be movable relative to the delivery member and configured to change between an open state where the opening is opened and a closed state where the opening is closed with the shutter member. The moving unit is reciprocally movable between a first position and a second position in a first direction connecting the first and second positions, the first position being a position where the moving unit connects with an apparatus main body of an image forming apparatus to deliver the developer to or from the apparatus main body, and the second position being a position where the moving unit does not connect with the apparatus main body. The shutter member is provided with a first contact portion configured to receive a force in a predetermined direction when the shutter member comes into contact with the apparatus main body, and a second contact portion configured to receive a force in a direction different from the predetermined direction when the shutter member comes into contact with the apparatus main body. When the moving unit is moved from the second position to the first position along the first direction, the first and second contact portions sequentially come into contact with the apparatus main body, such that the shutter member moves relative to the delivery member in the order of a second direction intersecting the first direction, and the first direction, and the opening changes from the closed state to the opened state.

An image forming apparatus according to the present disclosure includes an apparatus main body, and a moving unit including a delivery member provided with an opening and configured to deliver a developer through the opening, and a shutter member provided on the delivery member to be movable relative to the delivery member and configured to change between an opened state where the opening is opened and a closed state where the opening is closed with the shutter member. The moving unit is configured to mount a cartridge used for the apparatus main body, and is reciprocally movable between a first position and a second position in a first direction connecting the first and second positions, the first position being a position where the moving unit connects with an apparatus main body of an image forming apparatus to deliver the developer to or from the apparatus main body, and the second position being a position where the moving unit does not connect with the apparatus main body. The shutter member is provided with a first contact portion configured to receive a force in a predetermined direction when the shutter member comes into contact with the apparatus main body, and a second contact portion configured to receive a force in a direction different from the predetermined direction when the shutter member comes into contact with the apparatus main body. The apparatus main body is provided with a first main body contact portion which contacts the first contact portion to apply a force in a predetermined direction to the first contact portion, and a second main body contact portion which contacts the second contact portion to apply a force in a different direction to the second contact portion. When the moving unit is moved from the second position to the first position along the first direction, the first and second contact portions sequentially come into contact with the first and the second main body contact portions of the apparatus main body, respectively, such that the shutter member moves relative to the delivery member in the order of a second direction intersecting the first direction, and the first direction, and the opening changes from the closed state to the opened state.

Further features of the present disclosure will become apparent from the following description of exemplary embodiments with reference to the attached drawings.

DESCRIPTION OF THE EMBODIMENTS

An electrophotographic image forming apparatus according to the present disclosure will be described below with reference to the accompanying drawings. The following exemplary embodiments are to be considered as illustrative and the scope of the present disclosure is not limited to them. Sizes, materials, shapes, and relative positional arrangements of elements described in the exemplary embodiments are not limited thereto. Unless otherwise specifically described, the scope of the present disclosure is not limited to the exemplary embodiments described below.

An electrophotographic image forming apparatus refers to an apparatus for forming an image on a recording medium by using an electrophotographic image forming process. Examples of electrophotographic image forming apparatuses include electrophotographic copiers, electrophotographic printers (e.g., laser beam printers and light emitting diode (LED) printers), facsimile apparatuses, and word processors.

Configurations of an electrophotographic image forming apparatus (hereinafter referred to as an image forming apparatus) according to an exemplary embodiment of the present disclosure (hereinafter referred to as the present exemplary embodiment) and a moving unit used for the image forming apparatus will be described below with reference to the accompanying drawings.

A first exemplary embodiment of the present disclosure will be described below with reference to FIGS. 1 to 12.

(Overall Configuration of Image Forming Apparatus)

Figure 2:
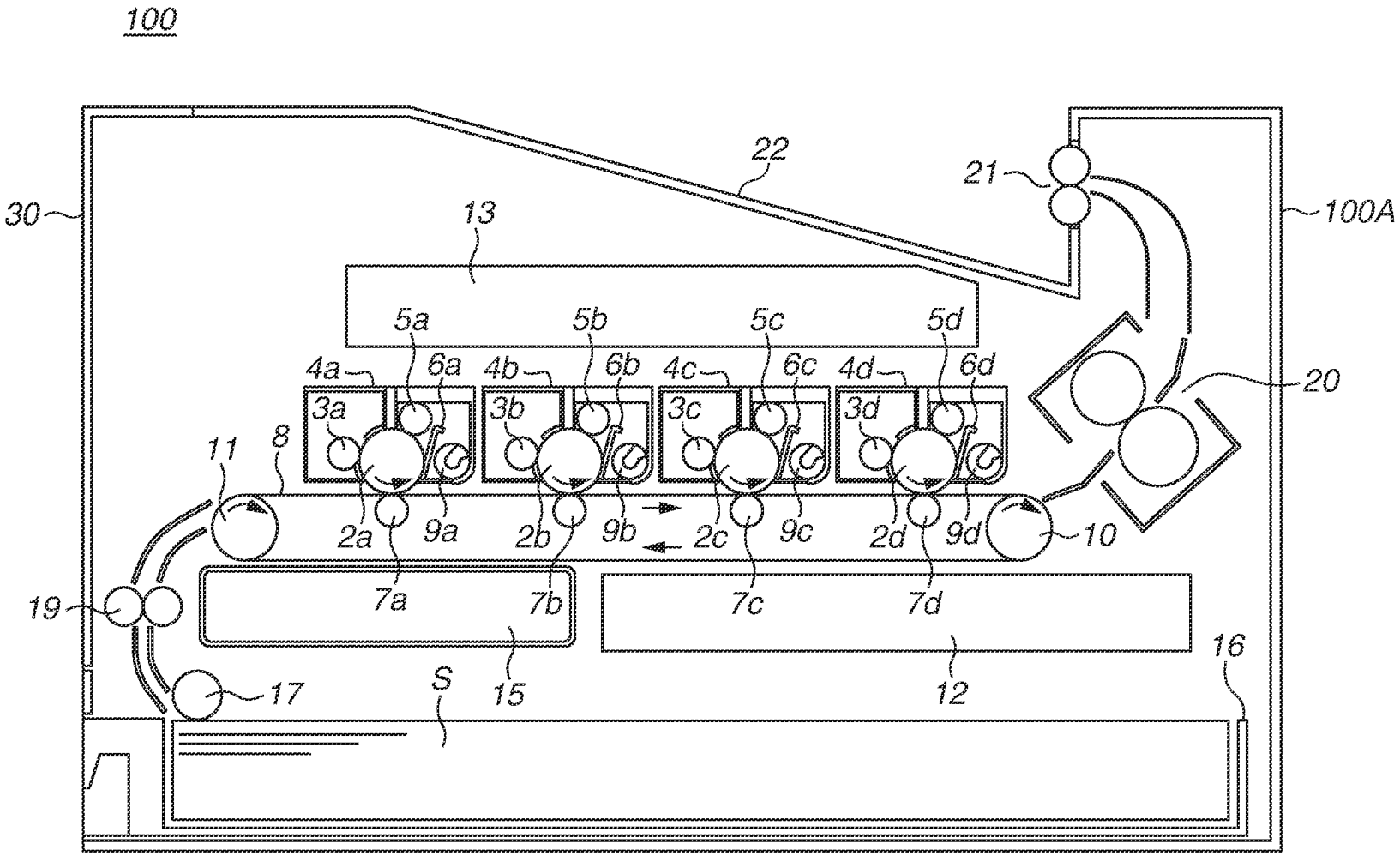
FIG. 2 is a cross-sectional conceptual view illustrating the image forming apparatus (excluding a waste toner conveyance mechanism) according to the first exemplary embodiment of the present disclosure.

FIG. 2 is a cross-sectional conceptual view illustrating the image forming apparatus (excluding a waste toner conveyance mechanism) according to the first exemplary embodiment of the present disclosure. More specifically, FIG. 2 illustrates the overall configuration of an electrophotographic color image forming apparatus 100 as an example of an apparatus using a shutter mechanism according to the first exemplary embodiment.

As seen from FIG. 2, the image forming apparatus 100 according to the present exemplary embodiment includes four photosensitive drums 2 (2*a* to 2*d*) approximately horizontally juxtaposed as image bearing members. As illustrated in FIG. 2, the photosensitive drums 2 are rotatably driven counterclockwise by a drive unit (not illustrated).

The image forming apparatus 100 further includes charging devices 5 (5*a*, 5*b*, 5*c*, and 5*d*) for uniformly charging the surfaces of the photosensitive drums 2, and a laser scanner unit 13 for irradiating the surfaces of the photosensitive drums 2 with a laser beam based on image information to form electrostatic latent images on the photosensitive drums 2. The image forming apparatus 100 further includes development devices 3 (3*a* to 3*d*) for applying toner to electrostatic latent images to develop toner images, and drum cleaning devices 6 (6*a* to 6*d*) for removing residual transfer toner remaining on the surfaces of the photosensitive drums 2 after image transfer. Toner discharge screws 9 (9*a* to 9*d*) for conveying residual transfer toner removed from the photosensitive drums 2 by the drum cleaning devices 6 are disposed in the vicinities of the drum cleaning devices 6.

In the image forming apparatus 100 according to the present exemplary embodiment, the photosensitive drums 2, the charging devices 5, the development devices 3, the drum cleaning devices 6, and the toner discharge screws 9 are integrally configured as process cartridges 4 (4*a* to 4*d*). The image forming apparatus 100 forms images of different colors (yellow, cyan, magenta, and black) through an electrophotographic recording process. The process cartridges 4 according to the present exemplary embodiment constitute cartridges of the present disclosure.

Transfer rollers 7 (7*a* to 7*d*) as transfer units are in contact with the photosensitive drums 2 via an endless transfer conveyance belt 8. Toner images on the photosensitive drums 2 are transferred onto a transfer material S that is conveyed being electrostatically attracted to the transfer conveyance belt 8. The transfer conveyance belt 8 is stretched by a drive roller 10 and a tension roller 11, and is rotated in the clockwise direction (FIG. 2) by the drive roller 10. A collected toner container 15 for storing collected residual transfer toner and a power source unit 12 are disposed under the transfer conveyance belt 8. The collected toner container 15 can be attached to and detached from an apparatus main body 100A to be replaced when the container 15 is filled to its capacity.

A sheet feeding cassette 16 disposed at the bottom of the apparatus, a feed roller 17, and a registration roller pair 19 for correcting a skew of a sheet S are disposed as units for feeding and conveying the sheet S.

A device 20 as a fixing unit fixes a toner image formed on the sheet S by the image forming unit for each color. A discharge roller pair 21 discharges the sheet S to a discharge tray 22 serving as a sheet stacking unit.

Printing operations of the apparatus will be described below. A predetermined number of sheets S stacked in the sheet feeding cassette 16 are fed one by one by the feed roller 17. Then, each of the sheets S passes through the registration roller pair 19 and then is conveyed onto the transfer conveyance belt 8. At nip portions between the photosensitive drums 2 and the transfer rollers 7 for different colors, the toner images of different colors formed on the surfaces of the photosensitive drums 2 are sequentially transferred in an overlapping way onto the sheet S electrostatically attracted to the surface of the transfer conveyance belt 8. Then, the sheet S is conveyed to the fixing device 20.

The fixing device 20 applies heat and pressure to the toner image transferred onto the sheet S. The sheet S with the toner images of different colors fixed thereon by the fixing device 20 passes through the discharge roller pair 21 and then is discharged to the discharge tray 22.

The image forming apparatus 100 includes a rotatable opening and closing door 30 (door member) for causing the process cartridge 4 (cartridge) as a replacement unit and the collected toner container 15, to be attached to and detached from the apparatus main body.

(Configuration of Cartridge Tray Unit)

Figure 3:
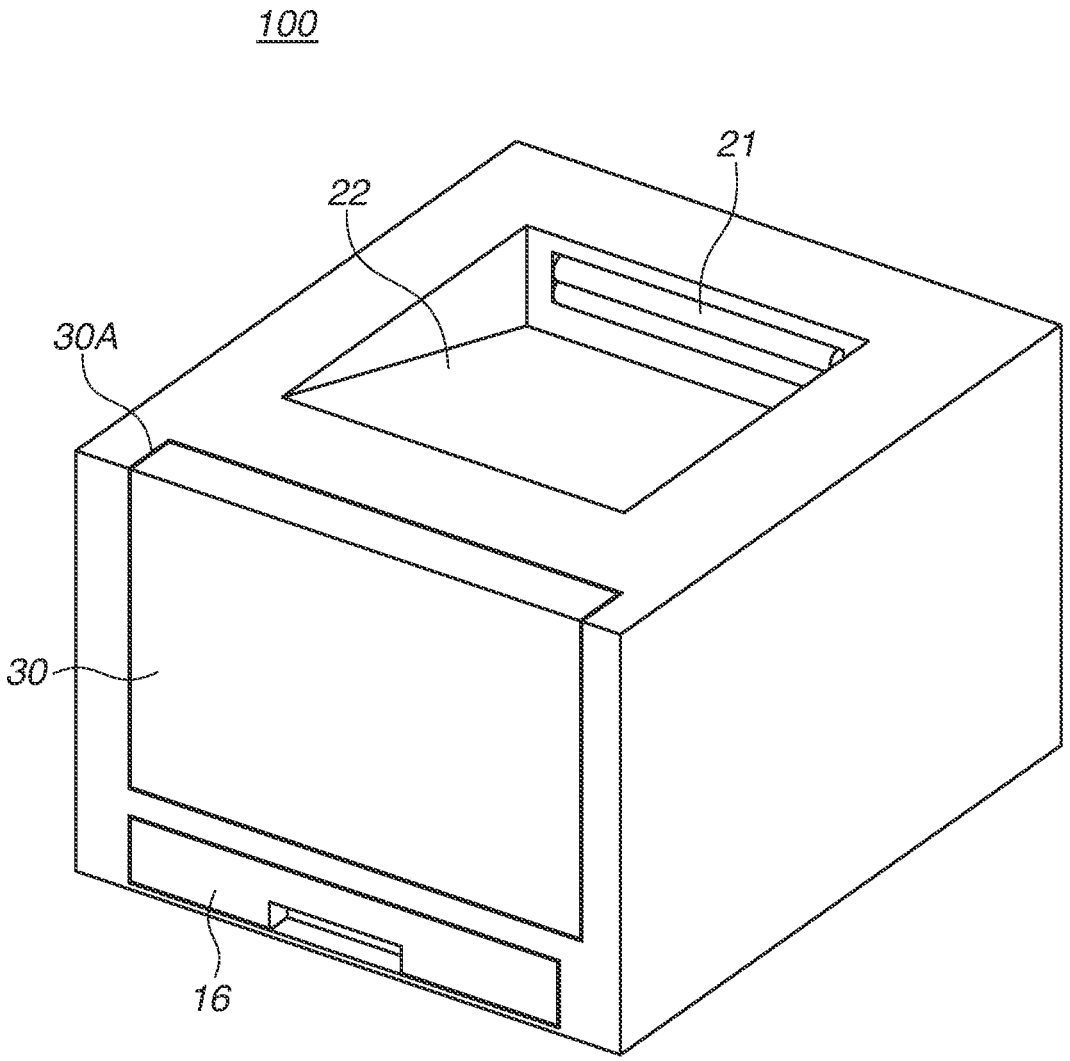
FIG. 3 is a perspective conceptual view illustrating the image forming apparatus according to the first exemplary embodiment of the present disclosure.
Figure 4:
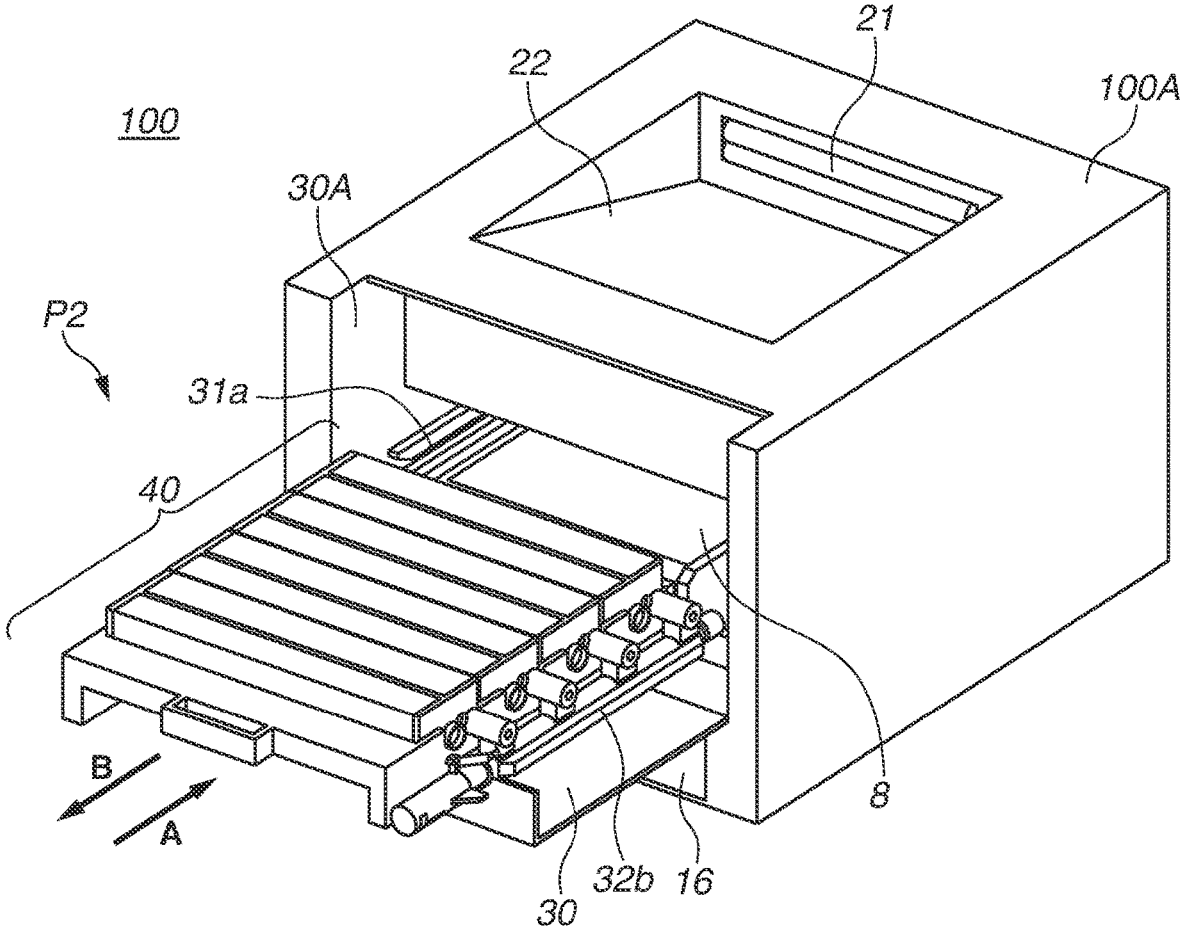
FIG. 4 is a perspective conceptual view, viewed from the waste toner conveyance mechanism side, illustrating a state where the cartridge tray unit is drawn from the main body of the image forming apparatus according to the first exemplary embodiment of the present disclosure.

FIG. 3 is a perspective conceptual view illustrating the image forming apparatus according to the first exemplary embodiment of the present disclosure. FIG. 4 is a perspective conceptual view, viewed from the waste toner conveyance mechanism side, illustrating a state where the cartridge tray unit is drawn from the main body of the image forming apparatus according to the first exemplary embodiment of the present disclosure.

Figure 5:
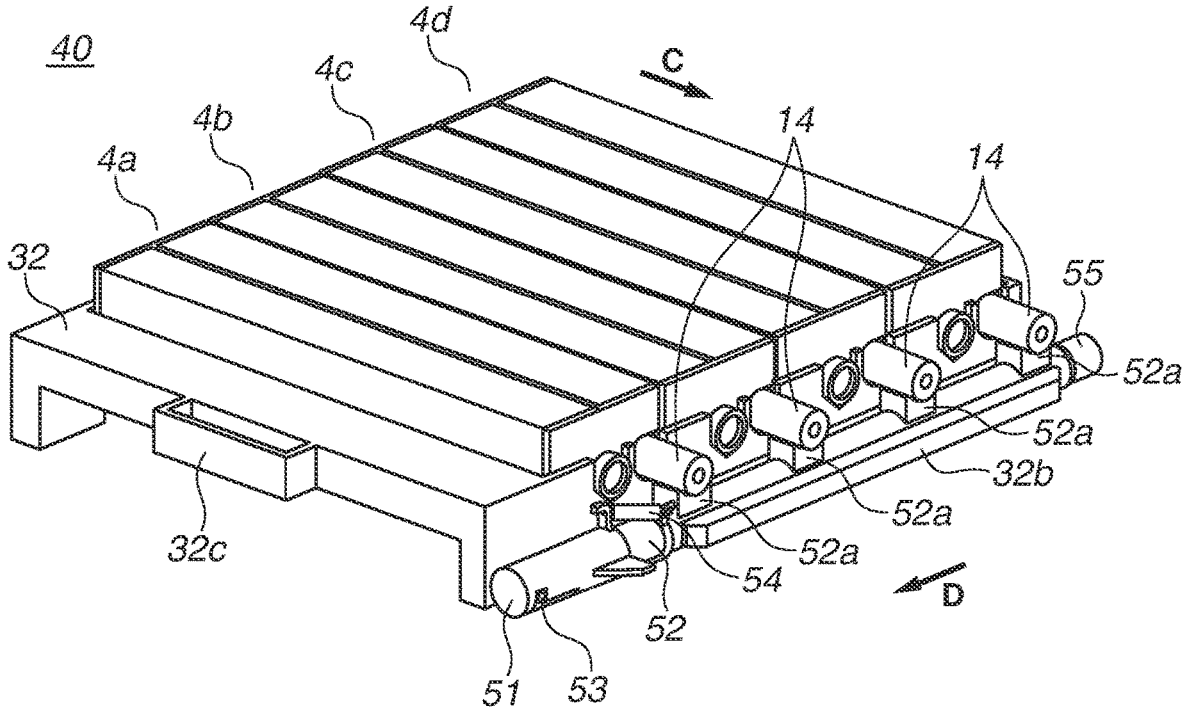
FIG. 5 is a perspective conceptual view illustrating the cartridge tray unit according to the first exemplary embodiment of the present disclosure.
Figure 6:
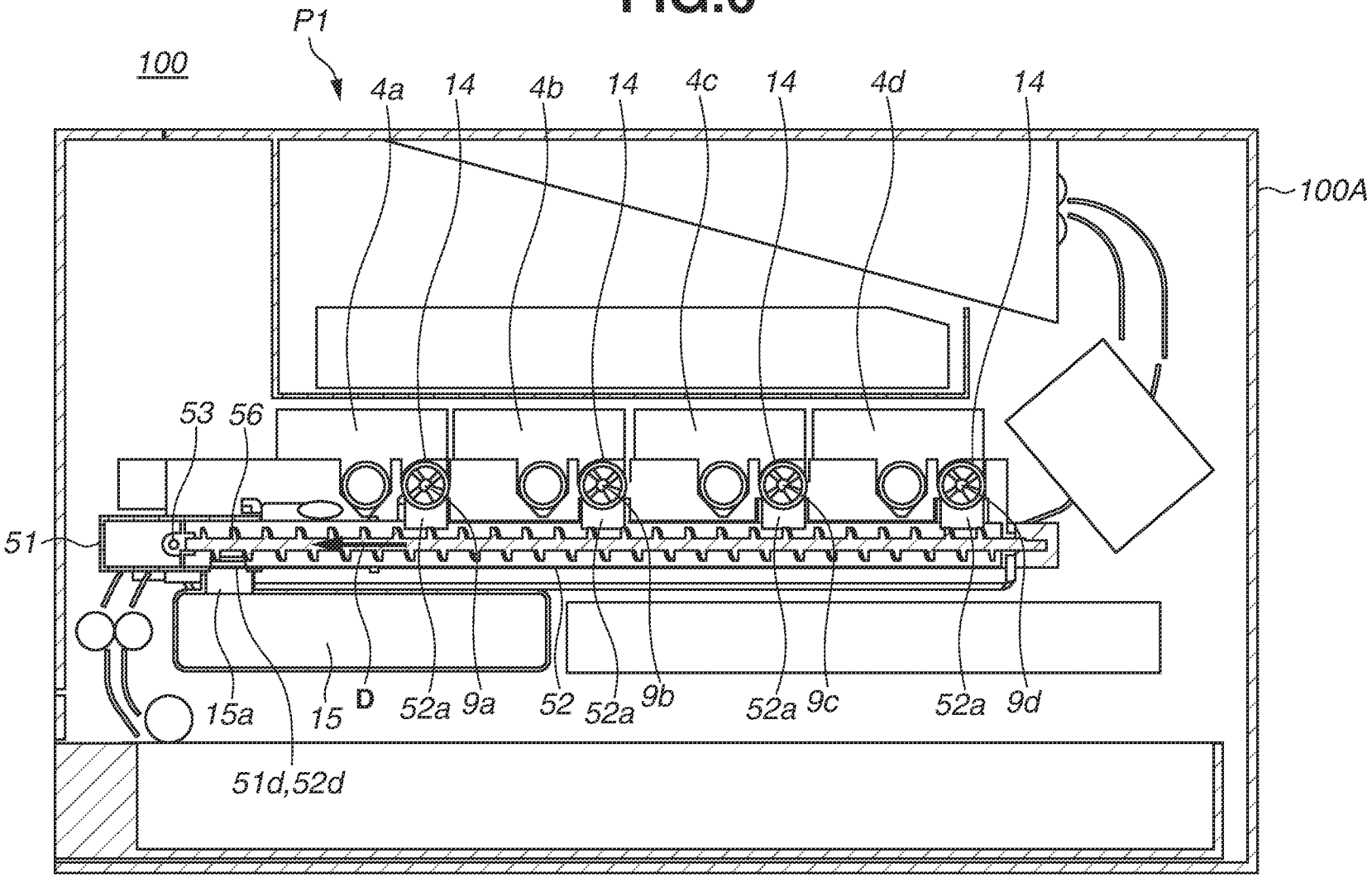
FIG. 6 is a cross-sectional conceptual view illustrating the image forming apparatus (including the waste toner conveyance mechanism) according to the first exemplary embodiment of the present disclosure.
Figure 7:
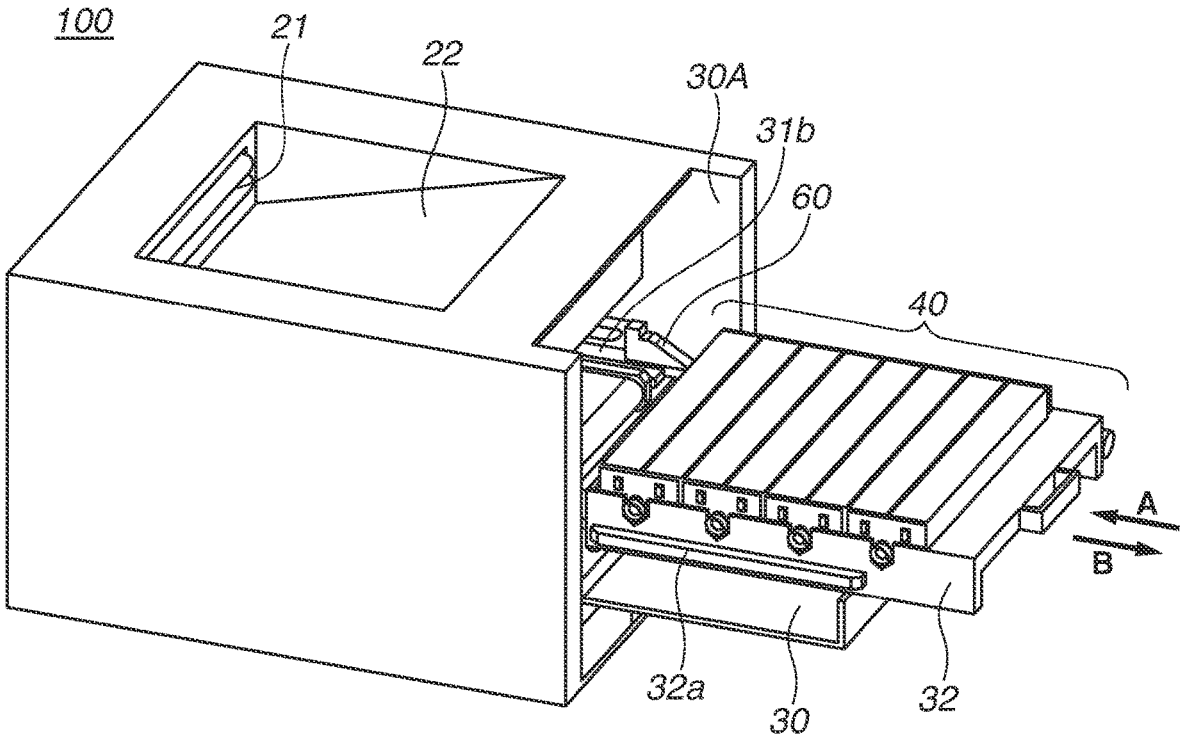
FIG. 7 is a perspective conceptual view, viewed from the opposite side of the waste toner conveyance mechanism side, illustrating a state where the cartridge tray unit is drawn from the main body of the image forming apparatus according to the first exemplary embodiment of the present disclosure.

FIG. 5 is a perspective conceptual view illustrating the cartridge tray unit according to the first exemplary embodiment of the present disclosure. FIG. 6 is a cross-sectional conceptual view illustrating the image forming apparatus (including the waste toner conveyance mechanism) according to the first exemplary embodiment of the present disclosure. FIG. 7 is a perspective conceptual view, viewed from the opposite side of the waste toner conveyance mechanism side, illustrating a state where the cartridge tray unit is drawn from the main body of the image forming apparatus according to the first exemplary embodiment of the present disclosure.

More specifically, FIG. 3 illustrates the outer appearance of the apparatus in a state where the opening and closing door 30 is closed. FIG. 4 illustrates the outer appearance of the apparatus in a state where the opening and closing door 30 is opened and the cartridge tray unit 40 (hereinafter may be simply referred to as a "unit 40") as an attachment/detachment unit is drawn. The opening and closing door 30 is disposed at a tray opening 30A of the apparatus main body 100A.

FIG. 7 illustrates the state illustrated in FIG. 4 viewed from a different angle. FIG. 6 is a cross-sectional schematic view illustrating the image forming apparatus 100 taken along the central cylindrical axis of a toner conveyance pipe 52 (delivery member).

The cartridge tray unit 40 is an example of an attachment/detachment unit (moving unit) for receiving toner, including the shutter mechanism which is a feature of the present exemplary embodiment.

As illustrated in FIGS. 4 and 7, tray side guide rails 32*a* and 32*b* are disposed on both sides of the unit 40. The tray side guide rails 32*a* and 32*b* are guided by main body side guide rails 31*a* and 31*b* on both sides inside the apparatus main body, respectively. An attachment and detachment operation of the unit 40 is performed along the direction AB (first direction).

FIG. 5 illustrates a configuration of the unit 40. As illustrated in FIG. 5, the four process cartridges 4 (4*a* to 4*d*) can be collectively disposed on a cartridge tray 32. The cartridge tray 32 is provided with a handle 32*c* for enabling the user to hold the unit 40 by hand when attaching or detaching the unit. Each of toner discharge pipes 14 protruding from the one end of the process cartridges 4 includes inside the toner discharge screw 9 illustrated in FIG. 2 and is provided with an opening (not illustrated) on the bottom surface.

The toner conveyance pipe 52 is configured in a hollow cylindrical form as a toner conveyance path member. In the toner conveyance pipe 52, a toner conveyance screw 56 (conveyance member) is rotatably supported. The toner conveyance pipe 52 is integrally formed with the cartridge tray 32 so as to intersect the toner discharge pipes 14 protruding from the process cartridges 4. The toner conveyance pipe 52 is provided with toner reception portions 52*a* as openings for receiving toner at the positions facing the openings on the bottom surfaces of the toner discharge pipes 14.

One end of the toner conveyance pipe 52 is provided with a shutter 51 (shutter member), and the other end thereof is provided with a drive coupling member 55. The drive coupling member 55 is connected to the toner conveyance screw 56 within the toner conveyance pipe 52, and engages with a drive unit (not illustrated) on the apparatus main body side in a state where the unit 40 is attached to the apparatus main body. The drive coupling member 55 transmits the drive power to the toner conveyance screw 56.

The shutter 51 movably engages with the outer circumferential surface of the cylinder of the toner conveyance pipe 52. A tension spring 54 (biasing member) is provided as a biasing unit between the shutter 51 and the toner conveyance pipe 52.

(Residual Transfer Toner Collection Process)

A process of collecting up residual transfer toner remaining on the photosensitive drums 2 to the collected toner container 15 will be described below with reference to FIGS. 2, 5, and 6.

As illustrated in FIGS. 2, 5, and 6, residual transfer toner scratched and removed from the surfaces of the photosensitive drums 2 by the drum cleaning devices 6 is conveyed in the direction C illustrated in FIG. 5 by the toner discharge screw 9. Then, the conveyed residual transfer toner is sent from the one ends of the process cartridges 4 to the protruding toner discharge pipes 14. Toner that has dropped from the bottom openings of the toner discharge pipes 14 by its own weight passes through the toner reception portions 52*a* and is stored within the cylinder of the toner conveyance pipe 52.

The residual transfer toner collected in the cylinder of the toner conveyance pipe 52 from the process cartridges 4 is collectively conveyed in the direction D by drive of the toner conveyance screw 56, and reaches a bottom opening 52*d* of the toner conveyance pipe 52.

In a state where the unit 40 is attached to the inside of the apparatus main body, the opening 51*d* of the shutter 51 is in the "Opened Position". At the position, the opening 51*d* is opened and communicates with the bottom opening 52*d* of the toner conveyance pipe 52. Therefore, the residual transfer toner conveyed to the bottom opening 52*d* of the toner conveyance pipe 52 drops by its own weight and then is accumulated in the collected toner container 15 through the opening 15*a* on the toner container 15.

(Configuration of Shutter Member)

The configuration of the shutter member 51 which is a feature of the present disclosure will be described below with reference to FIGS. 7 to 12A and 12B.

Figure 8A:
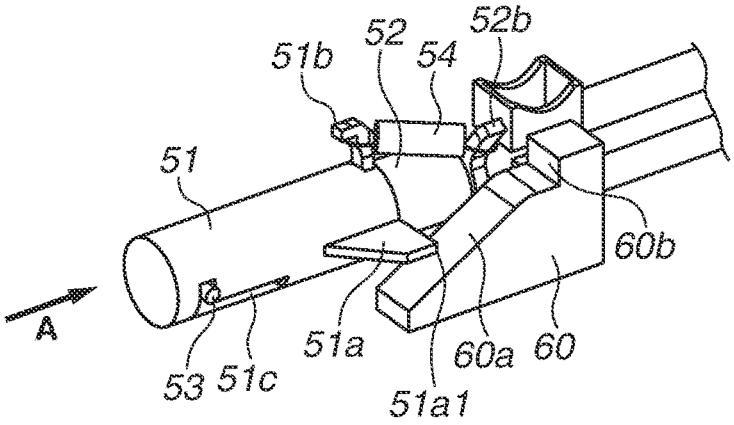
FIGS. 8A to 8C are perspective conceptual views, viewed from above, illustrating operations of the shutter mechanism according to the first exemplary embodiment of the present disclosure.
Figure 8B:
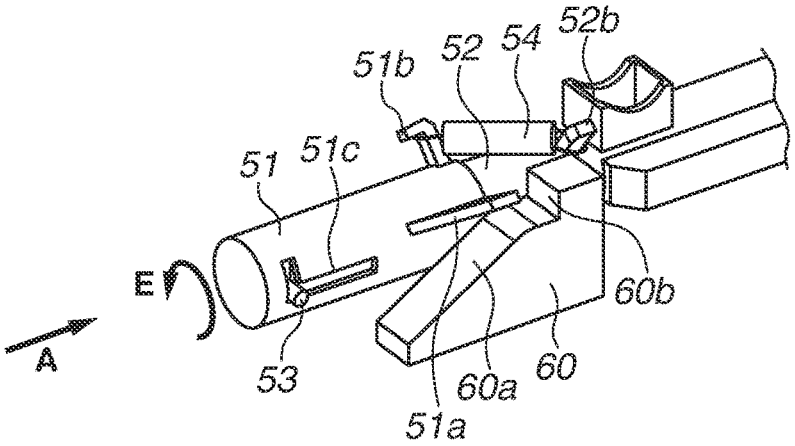
Figure 8C:
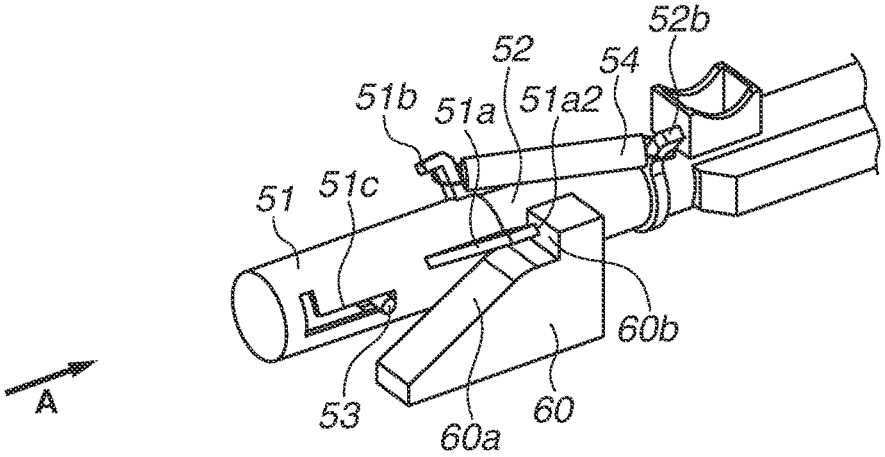
Figure 9A:
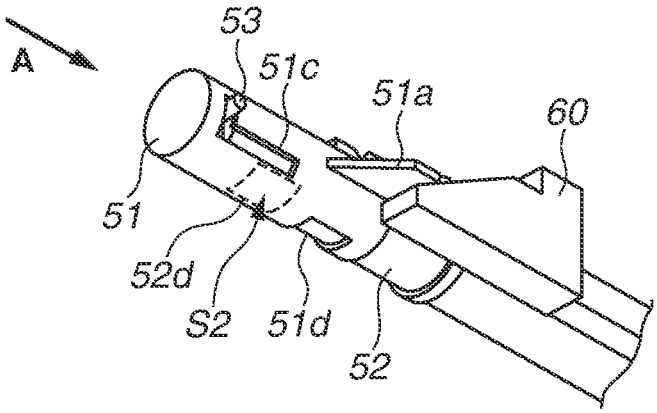
FIGS. 9A to 9C are perspective conceptual views, viewed from below, illustrating operations of the shutter mechanism according to the first exemplary embodiment of the present disclosure.
Figure 9B:
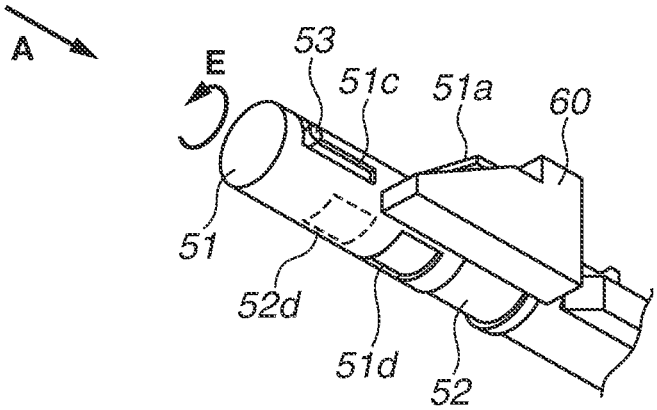
Figure 9C:
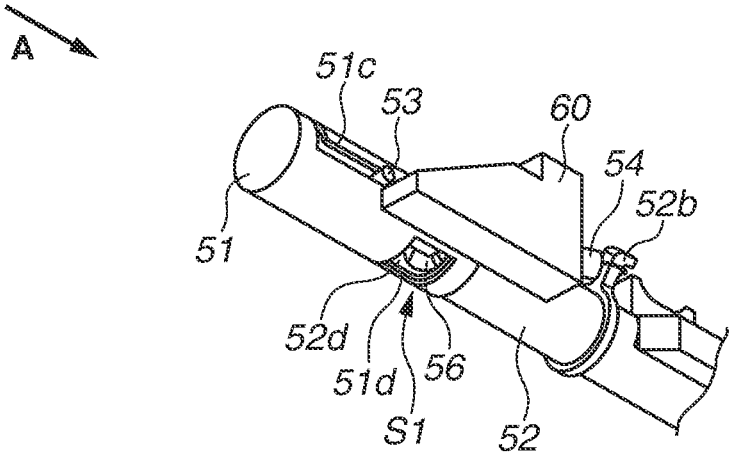

FIGS. 8A to 8C are perspective conceptual views, viewed from above, illustrating operations of the shutter mechanism according to the first exemplary embodiment of the present disclosure. FIGS. 9A to 9C are perspective conceptual views, viewed from below, illustrating operations of the shutter mechanism according to the first exemplary embodiment of the present disclosure.

Figure 10A:
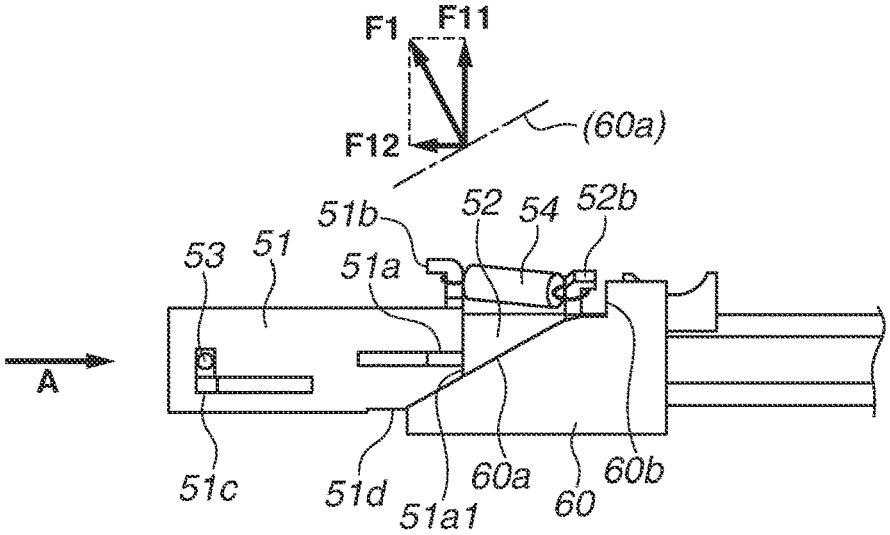
FIGS. 10A to 10C are lateral conceptual views illustrating operations of the shutter mechanism according to the first exemplary embodiment of the present disclosure.
Figure 10B:
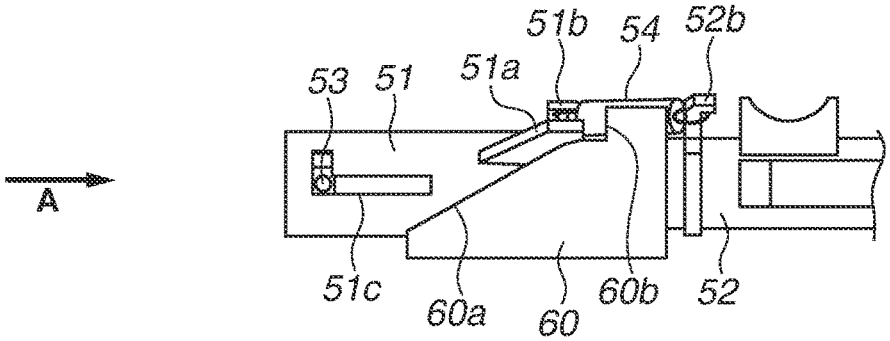
Figure 10C:
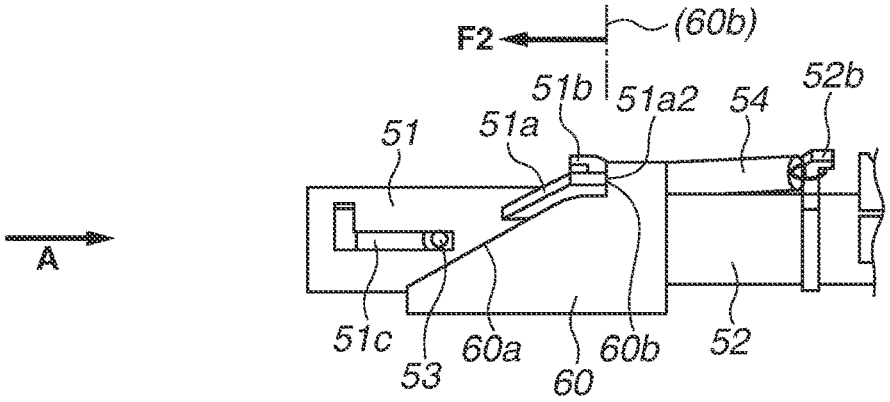
Figure 11:
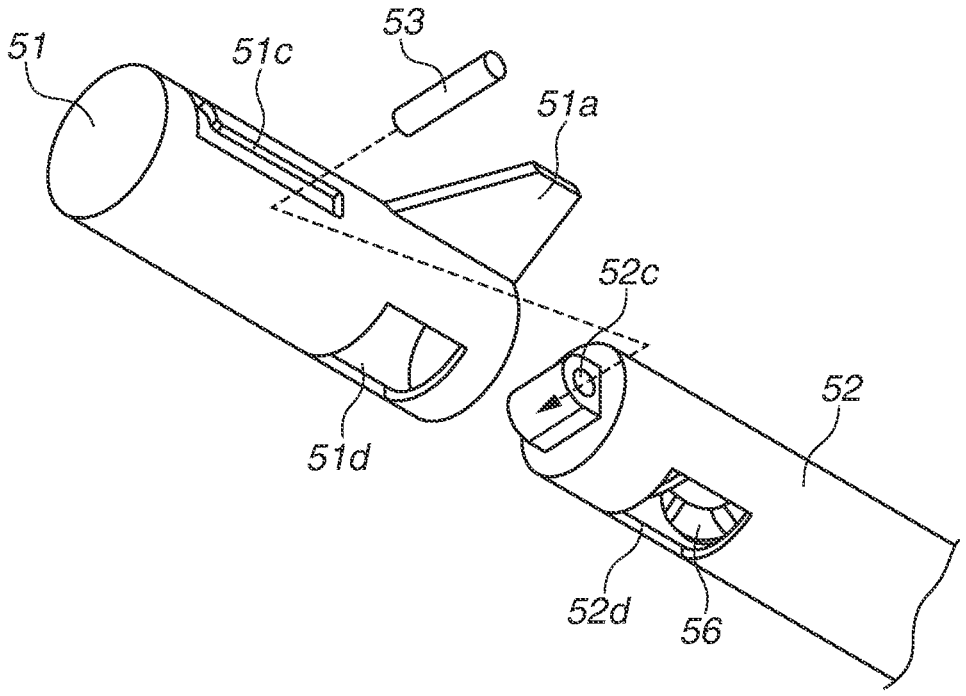
FIG. 11 is a perspective conceptual view illustrating a state where the shutter mechanism according to the first exemplary embodiment of the present disclosure is disassembled.
Figure 12A:
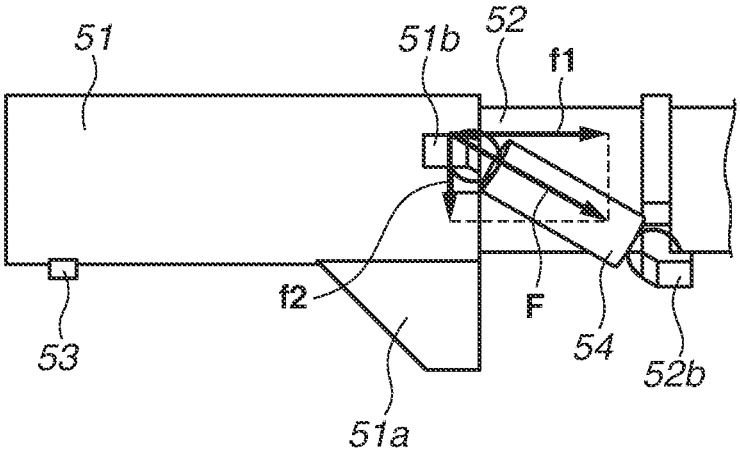
FIGS. 12A and 12B are top conceptual views illustrating the shutter mechanism according to the first exemplary embodiment of the present disclosure.
Figure 12B:
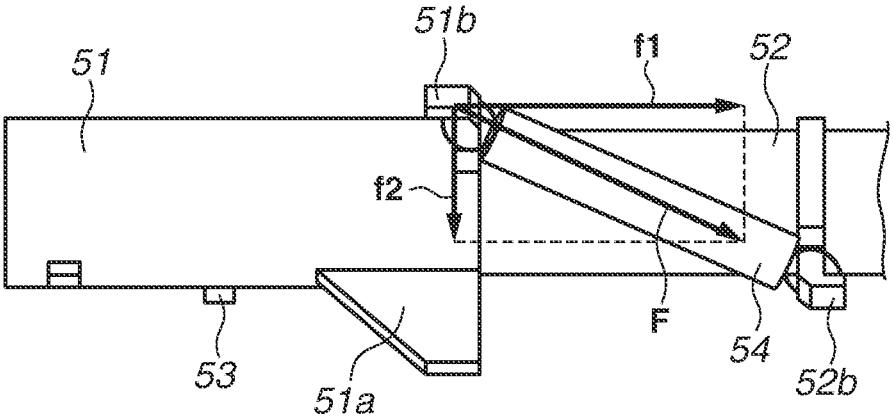

FIGS. 10A to 10C are lateral conceptual views illustrating operations of the shutter mechanism according to the first exemplary embodiment of the present disclosure. FIG. 11 is a perspective conceptual view illustrating a state where the shutter mechanism according to the first exemplary embodiment of the present disclosure is disassembled. FIGS. 12A and 12B are top conceptual views illustrating the shutter mechanism according to the first exemplary embodiment of the present disclosure.

More specifically, FIGS. 8A to 8C, 9A to 9C, and 10A to 10C illustrate states of the vicinities of the shutter 51, viewed from different angles, when the unit 40 is attached to the apparatus main body 100A of the image forming apparatus 100. FIGS. 8A, 8B, and 8C illustrate a time-sequential state transition in this order (this also applies to FIGS. 9A to 9C and FIGS. 10A to 10C).

FIG. 11 illustrate a state where the periphery of the shutter 51 is disassembled. FIGS. 12A and 12B illustrate states of the periphery of the shutter 51, viewed from above. In particular, FIG. 12A illustrates a state where the unit 40 is detached from the main body of the image forming apparatus 100 and the shutter 51 is closed, i.e., put in the closed position. FIG. 12B illustrates a state where the unit 40 is attached to the main body of the image forming apparatus 100 and the shutter 51 is opened, i.e., put in the opened position.

As illustrated in FIGS. 9A to 9C and 11, a part of the cylindrical surface of the toner conveyance pipe 52 is provided with the opening 52*d* for delivering toner.

The shutter 51 is a cylindrical member engaging with the outer circumferential surface of the cylinder of the toner conveyance pipe 52. Like the cylindrical toner conveyance pipe 52, the shutter 51 is also provided with the opening 51*d* on a part of the cylindrical surface. The shutter 51 is also provided with an L-shaped slit 51*c* on a part of the cylindrical surface different from the part of the opening 51*d*. The shutter 51 is also provided with a contact rib 51*a* as a portion to be brought into contact with a main body side contact member 60.

A guide boss 53 (first engaging guide member), which is fixed to the toner conveyance pipe 52, engages with an L-shaped slit 51*c* (second engaging guide member) of the shutter 51. The guide boss 53 has a role of regulating the movable direction of the shutter 51 relative to the toner conveyance pipe 52. The guide boss 53 according to the present exemplary embodiment is formed of a spring pin (protruding member), which is press-fit into a press-fitting hole 52*c* (refer to FIG. 11) at the tip of the toner conveyance pipe 52 through the L-shaped slit 51*c* serving as a groove, as illustrated in FIG. 11.

In the state illustrated in FIGS. 8A, 9A, and 10A, the unit 40 is taken out of the apparatus main body, and the shutter 51 is closing the opening 52*d* of the toner conveyance pipe 52. Therefore, at this timing, the shutter 51 is positioned at the "Closed Position" where the opening 51*d* of the shutter 51 and the opening 52*d* of the toner conveyance pipe 52 do not communicate with each other, as illustrated in FIG. 9A.

In the state illustrated in FIGS. 8C, 9C, and 10C, the unit 40 is attached to the inside of the apparatus main body, and the shutter 51 opens the opening 52*d* of the toner conveyance pipe 52. Therefore, at this timing, the shutter 51 is positioned at the "Opened Position" where the opening 51*d* of the shutter 51 and the opening 52*d* of the toner conveyance pipe 52 communicate with each other, as illustrated in FIG. 9C.

Referring to FIGS. 8A to 8C, 10A to 10C, and 12A and 12B, the tension spring 54 is bridged as a biasing member for biasing the shutter 51 to the closed position between a spring hook portion 52*b* of the toner conveyance pipe 52 and a spring hook portion 51*b* of the shutter 51.

Referring to FIGS. 12A and 12B, the arrow F represents the spring force applied to the spring hook portion 51*b* of the shutter 51 by the tension spring 54. An arrow f1 represents the component force of the spring force F along the direction of the cylindrical axis of the toner conveyance pipe 52, and an arrow f2 represents the remaining component force of the spring force F along the direction perpendicularly intersecting the component force f1.

The component force f1 produces a force in the thrust direction for restoring the shutter 51 to the "Closed Position". On the other hand, the component force f2 produces an angular moment for restoring the shutter 51 to the "Closed Position".

The contact member 60 is formed of a slope-like first contact portion 60*a* (first main body contact portion) and a perpendicular-wall-like second contact portion 60*b* (second main body contact portion) which sequentially come into contact with the contact rib 51*a* of the shutter 51 in the attachment/detachment process of the unit 40.

As illustrated in FIG. 11, according to the present exemplary embodiment, the toner conveyance pipe 52 of the unit 40 (moving unit) is provided with the bottom opening 52*d*, and the toner conveyance pipe 52 (delivery member) for delivering toner (developer) through the opening 52*d*.

As illustrated in FIGS. 9A to 9C, the toner conveyance pipe 52 is provided with the shutter 51 (shutter member) which is movable relative to the toner conveyance pipe 52 to change between an opened state S1 where the bottom opening 52*d* is opened and a closed state S2 where the bottom opening 52*d* is closed.

As illustrated in FIGS. 4 and 6, the unit 40 is reciprocally movable between a first position P1 and a second position P2 in a first direction AB connecting the first and the second positions. The first position P1 is a position where the unit 40 connects with the main body of the image forming apparatus to deliver the developer to the apparatus main body, and the second position is a position where the unit 40 does not connect with the apparatus main body.

As illustrated in FIGS. 10A to 10C, the contact rib 51*a* (contact portion) of the shutter 51 is provided with a first contact portion 51*a*1 that can receive a force F1 in a predetermined direction when the contact rib 51*a* contacts the apparatus main body, and a second contact portion 51*a*2 that can receive a force F2 in a direction different from the predetermined direction when the contact rib 51*a* contacts the apparatus main body. The first contact portion 51*a*1 is provided with a sliding portion 51*a*3 which is slidable in the apparatus main body when the shutter 51 moves relative to the toner conveyance pipe 52 in the second direction B/G. The force F1 can be represented by a component force F12 in the axial direction and a component force F11 in a direction (perpendicularly) intersecting the axial direction. In particular, the component of the component force F11 included in the force F1 differs from (perpendicularly intersects) the component in the direction of the force F2. In other words, the force F1 includes the component in a direction different from the direction of the force F2.

(Operations of Shutter Member)

Operations of the shutter mechanism will be described below with reference to FIGS. 1A and 1B, 8A to 8C, and 10A to 10C.

Figure 1A:
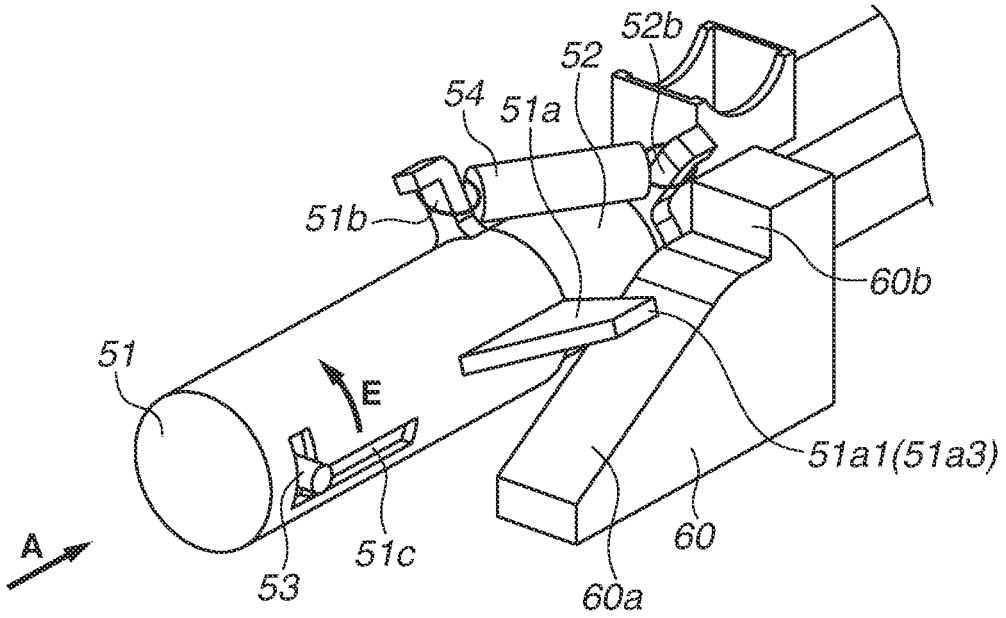
FIGS. 1A and 1B are perspective conceptual views illustrating a main portion around a shutter mechanism in a cartridge tray unit used in an image forming apparatus according to a first exemplary embodiment of the present disclosure.
Figure 1B:
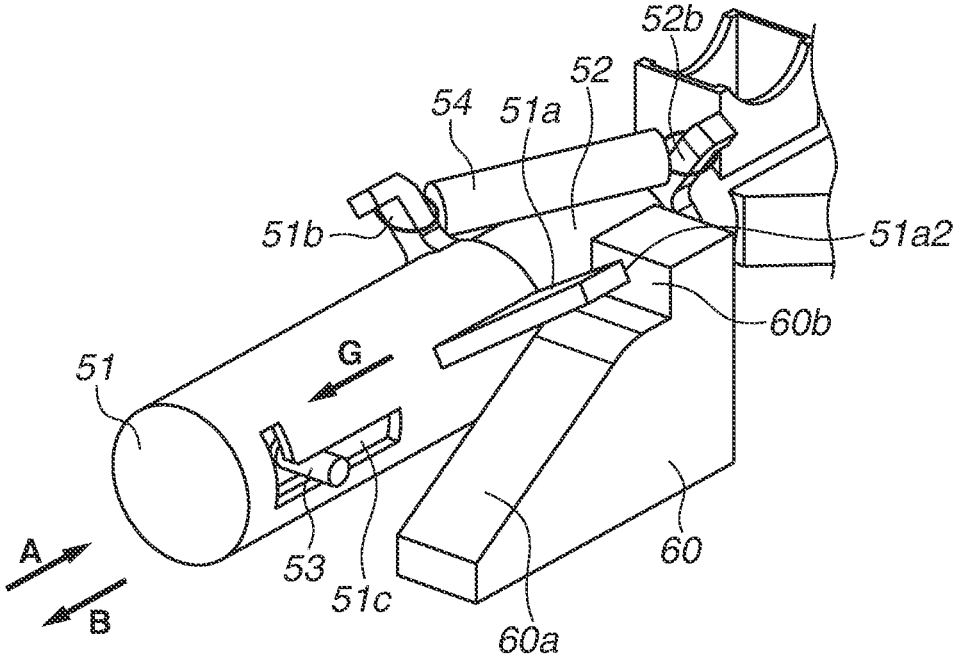

FIGS. 1A and 1B are perspective conceptual views illustrating a main portion around the shutter mechanism in the cartridge tray unit 40 used in the image forming apparatus according to the first exemplary embodiment of the present disclosure.

FIGS. 8A to 8C, 9A to 9C, and 10A to 10C sequentially illustrate a process of attaching the unit 40 in the direction A from a state where the unit 40 is taken out of the apparatus main body as illustrated in FIGS. 4 and 7.

More specifically, FIGS. 8A, 9A, and 10A illustrate a state before the contact rib 51*a* of the shutter 51 comes into contact with the first contact portion 60*a* of the main body side contact member 60. In this state, the shutter 51 is in the "Closed Position". FIGS. 8C, 9C, and 10C illustrate a state where the unit 40 has been attached and the shutter 51 is in the "Opened Position". FIGS. 8B, 9B, and 10B illustrate an intermediate state during the transition from the state illustrated in FIGS. 8A, 9A, and 10A to the state illustrated in FIGS. 8C, 9C, and 10C. In this intermediate state, the guide boss 53 is placed at a cross point of the L-shaped slit 51*c*.

FIG. 1A illustrates an intermediate state during the transition from the state illustrated in FIGS. 8A, 9A, and 10A to the state illustrated in FIGS. 8B, 9B, and 10B. In this intermediate state, the contact rib 51*a* of the shutter 51 is in contact with the first contact portion 60*a* of the main body side contact member 60.

FIG. 1B illustrates an intermediate state during the transition from the state illustrated in FIGS. 8B, 9B, and 10B to the state illustrated in FIGS. 8C, 9C, and 10C. In the intermediate state, the contact rib 51*a* of the shutter 51 is in contact with the second contact portion 60*b* of the main body side contact member 60.

In the state illustrated in FIG. 1A, the movement of the shutter 51 in the thrust direction is regulated by the guide boss 53 and the L-shaped slit 51*c*. At the time, the contact rib 51*a* is raised by the slope-like first contact portion 60*a*. This rotates the shutter 51 in the second direction E relative to the toner conveyance pipe 52 around the axis along the longitudinal direction (in a first direction A/B). More specifically, the first direction A/B can be the axis direction of the cylindrical shutter 51, and the second direction E can be the circumferential direction of the cylindrical shutter 51. The second direction E perpendicularly intersects the first direction A/B (i.e., exists on a perpendicularly intersecting plane).

Then, in this intermediate state illustrated in FIGS. 8B, 9B, and 10B during the transition from the state illustrated in FIG. 1A to the state illustrated in FIG. 1B, the direction of the regulation given to the shutter 51 by the guide boss 53 is changed. In this case, the contact portion of the main body side contact member 60 in contact with the contact rib 51*a* of the shutter 51 is also changed from the first contact portion 60*a* to the second contact portion 60*b*.

In the state illustrated in FIG. 1B, while the shutter 51 is being regulated in the movement in the rotational direction by the guide boss 53 and the L-shaped slit 51*c*, the contact rib 51*a* comes into contact with the perpendicular-wall-like second contact portion 60*b*. When the contact rib 51*a* comes into contact with the second contact portion 60*b*, the shutter 51 slides (moves) in the first direction G (identical to the direction B) relative to the toner conveyance pipe 52.

When the unit 40 has been attached, the unit enters the state as illustrated in FIGS. 8C, 9C, and 10C. In the state, the shutter 51 is in the "Opened Position" where the opening 51*d* of the shutter 51 and the bottom opening 52*d* of the toner conveyance pipe 52 communicate with each other.

As described above, the shutter 51 is constantly biased toward the "Closed Position" by the tension spring 54. Therefore, when the unit 40 is detached from the main body of the image forming apparatus 100, the shutter 51 moves stepwise in the direction opposite to the G direction and in the direction opposite to the E direction when the unit 40 is attached. Accordingly, the shutter 51 moves from the "Opened Position" to the "Closed Position".

More specifically, when the moving unit is moved from the second position P2 to the first position P1 along the first direction A, the first contact portion 51*a*1 and then the second contact portion 51*a*2 sequentially come into contact the apparatus main body 100A/60. Thus, the shutter member moves relative to the delivery member in the second direction E intersecting the first direction and then in the first direction B/G, and the opening is changed from the closed state S2 to the open state S1.

As described above, according to the present disclosure the shutter member can be prevented from being opened due to the careless operation, and can be opened in a simple configuration when the moving unit is attached to the apparatus main body.

More specifically, according to the present exemplary embodiment, the shutter 51 moves stepwise in the second direction E illustrated in FIG. 1A and then in the first direction GB illustrated in FIG. 1B. Accordingly, the shutter 51 makes a state transition from the "Closed Position" illustrated in FIGS. 8A, 9A, and 10A to the "Opened Position" illustrated in FIGS. 8C, 9C, and 10C.

This means that, even if something improperly contacts the shutter 51 in a state where the unit 40 is taken out of the apparatus main body, the above-described stepwise movement in the two directions hardly occurs.

The configuration can realize an image forming apparatus including an attachment/detachment unit that does not leak toner due to careless opening of the shutter, without a complicated lock mechanism. This can also realize the opening of the shutter member in the simple configuration when the moving unit is attached to the apparatus main body.

A second exemplary embodiment of the present disclosure will be described below with reference to FIGS. 13 and 14 and the first exemplary embodiment (FIGS. 8A to 8C, 9A to 9C, and 10A to 10C).

The configuration of the second exemplary embodiment is basically similar to the configuration of the first exemplary embodiment (refer to FIGS. 8A to 8C, 9A to 9C, and 10A to 10C). Differences of the second exemplary embodiment from the first exemplary embodiment will be described below. Configurations similar to those according to the first exemplary embodiment are assigned the same reference numerals. In the above-described image forming apparatus 100 according to the first exemplary embodiment, the contact portion of the shutter 51 contacts the first contact portion 60*a* and the second contact portion 60*b* of the main body side contact member 60 (i.e., the opening and closing operation of the shutter) based on the attachment and detachment operation of the cartridge tray 32. On the other hand, according to the second exemplary embodiment, the opening and closing operation of the shutter is performed based on the opening and closing operation of an opening and closing door.

Figure 13:
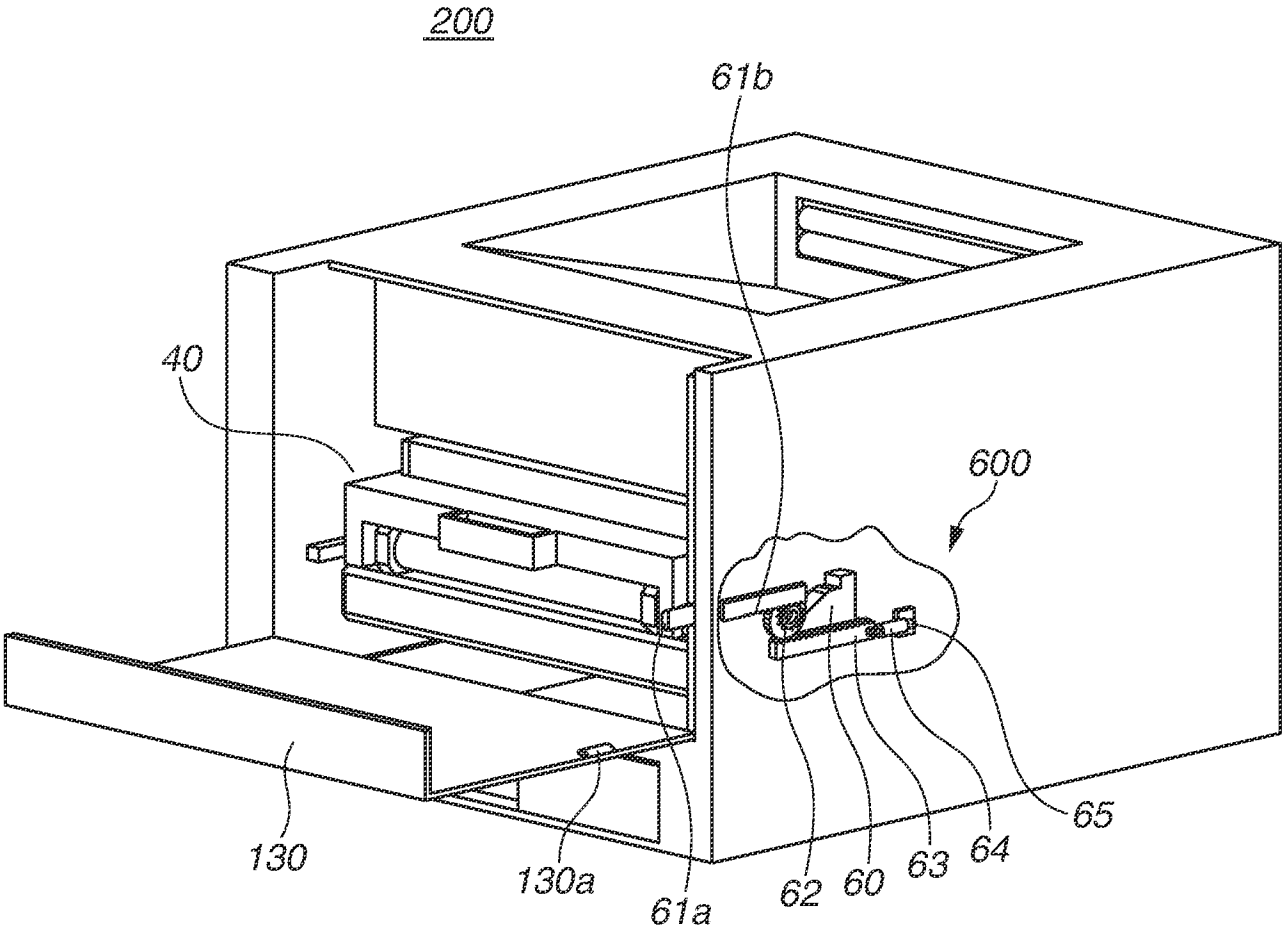
FIG. 13 is a perspective conceptual view illustrating a state where an opening and closing door of the image forming apparatus according to a second exemplary embodiment of the present disclosure is opened.

FIG. 13 is a perspective conceptual view illustrating a state where the opening and closing door of the image forming apparatus according to the second exemplary embodiment of the present disclosure is opened. FIG. 14 is a perspective conceptual view illustrating a state where the opening and closing door of the image forming apparatus according to the second exemplary embodiment of the present disclosure is closed.

Figure 14:
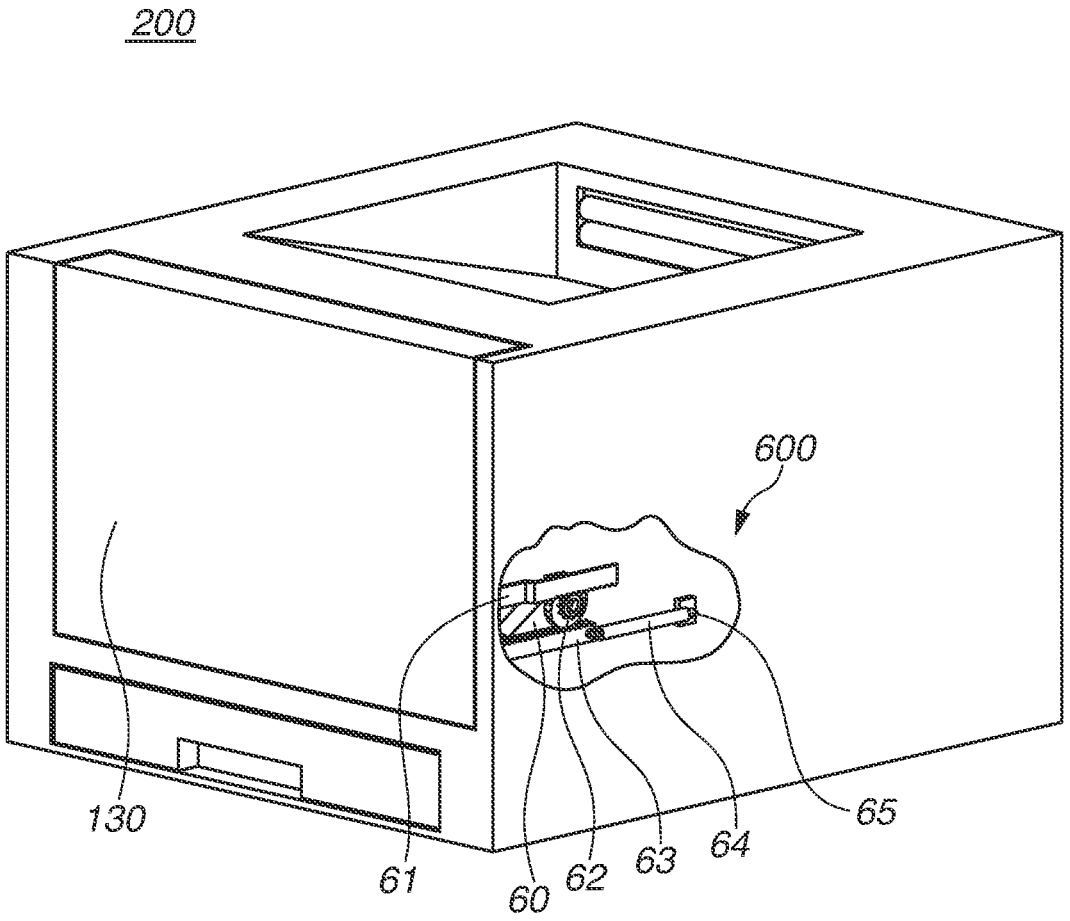
FIG. 14 is a perspective conceptual view illustrating a state where the opening and closing door of the image forming apparatus according to the second exemplary embodiment of the present disclosure is closed.

More specifically, FIG. 13 is an external perspective view illustrating a state where an opening and closing door 130 of the image forming apparatus 200 according to the second exemplary embodiment of the present disclosure is opened, and FIG. 14 is an external perspective view illustrating a state where the opening and closing door 130 is closed. In these drawings, the vicinity of the contact member 60 is partially visualized to illustrate the inner structure.

As illustrated in FIGS. 13 and 14, the present exemplary embodiment is provided with a link mechanism 600 which is movable between the first contact portion 51*a*1 and the second contact portion 51*a*2 in association with the opening and closing operation of the opening and closing door 30. For example, the link mechanism 600 may be provided with a link lever 61, a pinion gear 62, a contact member support member 63, a link spring 64, and a spring hook 65.

More specifically, according to the present exemplary embodiment, the link lever 61 is slidably supported in the horizontal direction relative to the apparatus main body. The link lever 61 is provided with a door contact surface 61*a* that contacts an abutting portion 130*a* of the opening and closing door 130, and a rack gear 61*b* that engages with a pinion gear 62 rotatably supported by the apparatus main body. The contact member support member 63 is also slidably supported in the horizontal direction relative to the apparatus main body, and is also provided with a rack gear engaging with the pinion gear 62. The contact member support member 63 is biased toward a predetermined direction by the link spring 64 bridged between the spring hook 65 fixed to the apparatus main body and the contact member support member 63.

According to the first exemplary embodiment, the main body side contact member 60 is provided as a member fixed to the apparatus main body. On the other hand, according to the present exemplary embodiment, the main body side contact member 60 is fixed to the contact portion bearing member 63 slidably movable relative to the main body of the image forming apparatus 200, and is slidably movable together with the contact portion bearing member 63.

According to the present (second) exemplary embodiment, the shutter 51 is not changed from the "Closed State" to the "Opened State" only by attaching the unit 40 to the inside of the apparatus main body. More specifically, in a state where the opening and closing door 130 is opened as illustrated in FIG. 13, the main body side contact member 60 is in a retracted position where the main body side contact member 60 does not contact the contact rib 51*a* of the shutter 51 by the urging force of the link spring 64. Therefore, in the state illustrated in FIG. 13, the shutter 51 is in the "Closed Position" like the state illustrated in FIGS. 8A, 9A, and 10A.

On the other hand, as the opening and closing door 130 is closed from the state illustrated in FIG. 13, the abutting portion 130*a* of the opening and closing door 130 comes into contact with the door contact surface 61*a* of the link lever 61 and then pushes into and slides the link lever 61. With the slide movement of the link lever 61, the contact portion support member 63 slidably moves together with the main body side contact member 60 via the pinion gear 62 against the urging force of the link spring 64.

The relative positional relation between the main body side contact member 60 (which slidably moves by the closing operation of the opening and closing door 130) and the shutter 51 of the unit 40 is set such that the unit enters the state illustrated in FIGS. 8C, 9C, and 10C when the opening and closing door 130 is closed.

Therefore, the relative positional relation between the shutter 51 and the main body side contact member 60 during the process from the open state (FIG. 13) of the opening and closing door 130 (through which the unit 40 is attached to the inside of the apparatus main body) to the closed state (FIG. 14) thereof is the same as that illustrated in FIGS. 8A to 8C, 9A to 9C, and 10A to 10C. More specifically, the shutter 51 moves from the "Closed Position" to the "Opened Position" in association with the closing operation of the opening and closing door 130.

On the contrary, when the opening and closing door 130 is changed from the closed state (FIG. 14) to the opened state (FIG. 13), the main body side contact member 60 slidably moves together with the contact member bearing member 63 by the urging force of the link spring 64 to retract from the shutter 51. Therefore, the shutter 51 moves from the "Opened Position" to the "Closed Position" in association with the opening operation of the opening and closing door 130.

More specifically, in the image forming apparatus according to the present exemplary embodiment, the opening and closing operation of the shutter 51 is started when the unit 40 has been attached to the apparatus main body.

The present exemplary embodiment has been described above taking an example of a link mechanism using a rack and a pinion gear as a unit for linking the main body side contact member 60 with the opening and closing operation of the opening and closing door 130. However, the effects of the present disclosure are not influenced even when other linking units are used.

A third exemplary embodiment of the present disclosure will be described below with reference to FIGS. 15 and 18A to 18E.

The configuration of the third exemplary embodiment is basically similar to the configuration of the first exemplary embodiment (refers to FIGS. 8A to 8C, 9A to 9C, and 10A to 10C) and provides similar effects. Differences of the third exemplary embodiment from the first exemplary embodiment will be described below. Configurations similar to those in the first exemplary embodiment are assigned the same reference numerals. The third exemplary embodiment includes a unit 140 and a main body side contact member 160 which are different from those according to the above-described first exemplary embodiment. Other configurations are similar to those of the first exemplary embodiment.

Figure 15:
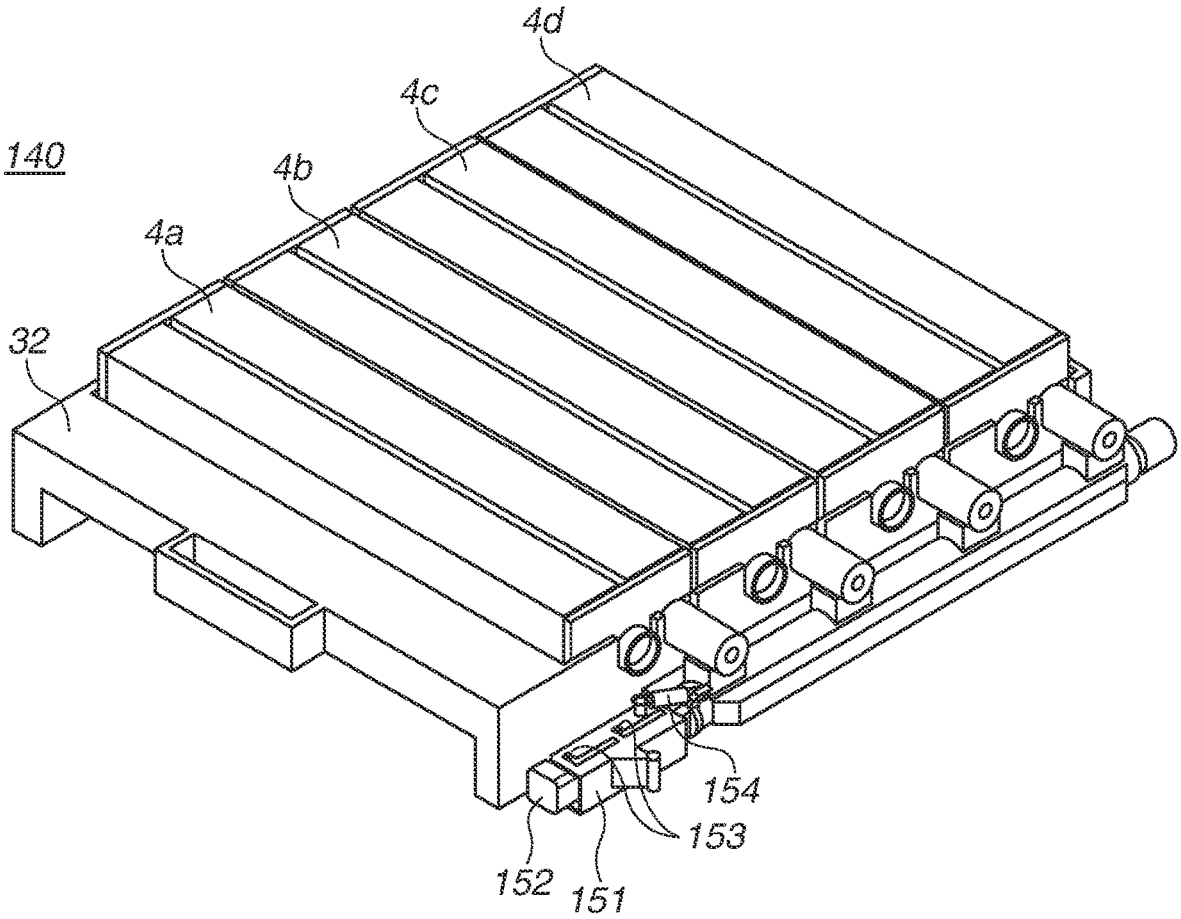
FIG. 15 is a perspective conceptual view illustrating a cartridge tray unit used in an image forming apparatus according to a third exemplary embodiment of the present disclosure.

FIG. 15 is a perspective conceptual view illustrating a cartridge tray unit used in an image forming apparatus according to the third exemplary embodiment of the present disclosure. FIGS. 16A to 16E are perspective conceptual views, viewed from above, illustrating operations of the shutter mechanism according to the third exemplary embodiment of the present disclosure. FIGS. 17A to 17E are top conceptual views illustrating operations of the shutter mechanism according to the third exemplary embodiment of the present disclosure. FIGS. 18A to 18E are bottom conceptual views illustrating operations of the shutter mechanism according to the third exemplary embodiment of the present disclosure.

More specifically, FIG. 15 illustrates the configuration of the unit 140 as an attachment/detachment unit according to the present exemplary embodiment. FIGS. 16A to 16E, 17A to 17E, and 18A to 18E illustrate states in the vicinities of a shutter 151, viewed from different angles, when a unit 140 is attached to the main body of the image forming apparatus 100. FIGS. 16A, 16B, 16C, 16D, and 16E illustrate a time-sequential state transition in this order (this also applies to FIGS. 17A to 17E and FIGS. 18A to 18E).

As illustrated in FIGS. 15, 16A to 16E, 17A to 17E, and 18A to 18E, the shutter 151 is slidably attached to the toner conveyance pipe 152 which is provided with a bottom opening 152*d* for discharging toner such that the opening 152*d* can be opened and closed. Guide bosses 153 fixed to the top surface of the toner conveyance pipe 152 protrude from two L-shaped slits 151*c* on the shutter 151. The guide bosses 153 regulate the moving direction of the shutter 151 relative to the toner conveyance pipe 152. The shutter 151 can move between the "Closed Position" where the bottom opening 152*d* is closed (the state illustrated in FIGS. 16A, 17A, and 18A) and the "Opened Position" where the bottom opening 152*d* is opened (the state illustrated in FIGS. 16E, 17E, and 18E). In the case, the guide bosses 153 are guided (regulated) by the L-shaped slits 151*c*. A tension spring 154 is bridged between spring hook portions 151*b* and 152*b* on the shutter 151 and the toner conveyance pipe 152, respectively. The shutter 151 is constantly biased toward the "Closed Position" by the tension spring 154. The shutter 151 is also provided with a contact portion 151*a* to be in contact with the main body side contact member 160.

The contact member 160 is fixedly disposed in the apparatus main body, and is provided with a first contact portion 160*a* and a second contact portion 160*b* which contacts the contact portion 151*a* of the shutter 151.

The movement of the shutter 151 in the process of attaching the unit 140 in the A direction will be described below with reference to FIGS. 16A to 16E, 17A to 17E, and 18A to 18E.

Figure 16A:
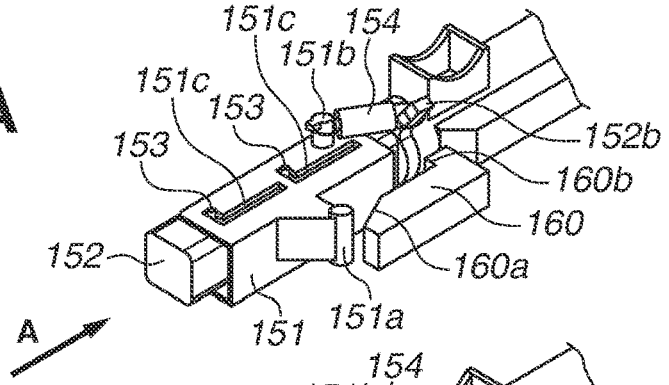
FIGS. 16A to 16E are perspective conceptual views, viewed from above, illustrating operations of a shutter mechanism according to the third exemplary embodiment of the present disclosure.
Figure 17A:
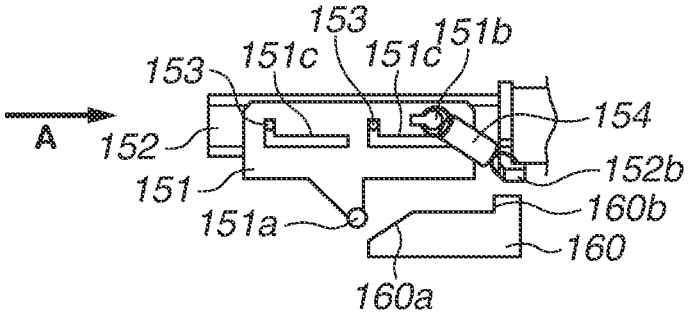
FIGS. 17A to 17E are top conceptual views illustrating operations of the shutter mechanism according to the third exemplary embodiment of the present disclosure.
Figure 18A:
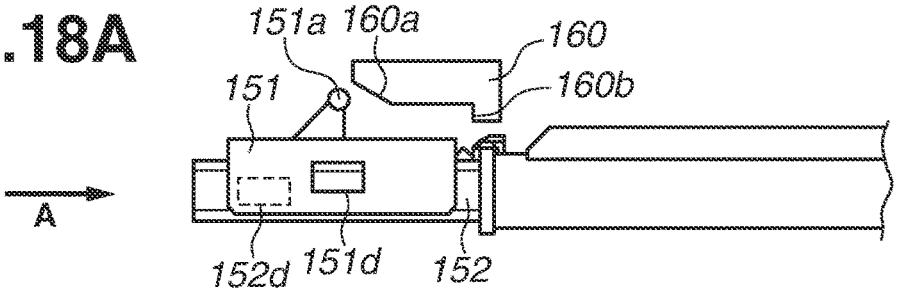
FIGS. 18A to 18E are bottom plan views illustrating operations of the shutter mechanism according to the third exemplary embodiment of the present disclosure.

In the state illustrated in FIGS. 16A, 17A, and 18A, the contact portion 151*a* of the shutter 151 is separated from the main body side contact member 160, and the shutter 151 is in the "Closed Position".

Figure 16B:
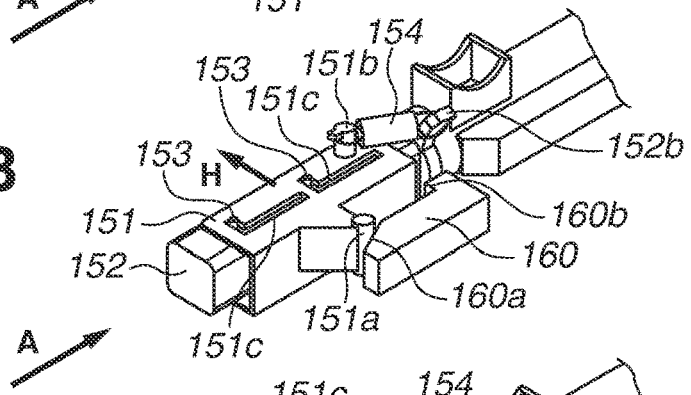
Figure 17B:
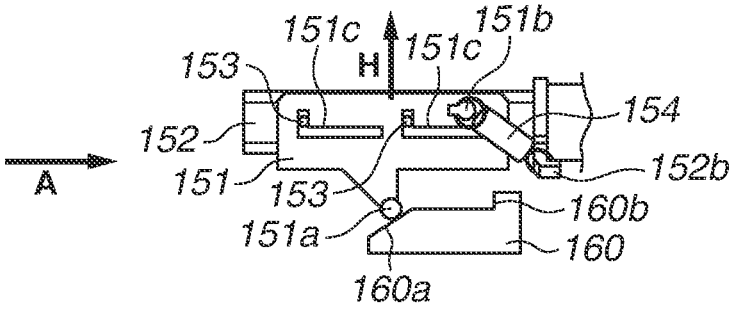
Figure 18B:
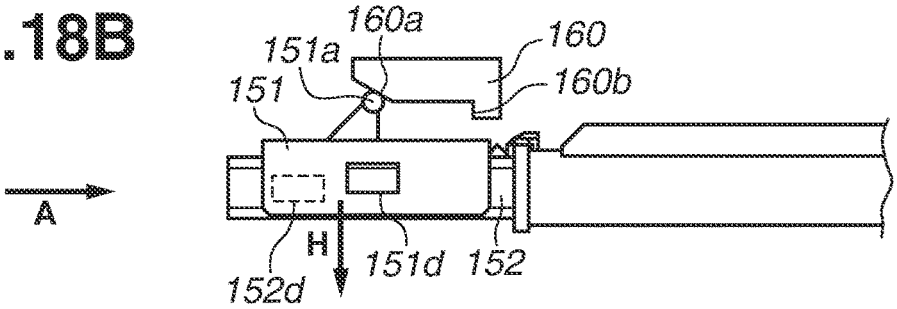

In the state illustrated in FIGS. 16B, 17B, and 18B, the contact portion 151*a* of the shutter 151 comes into contact with the slope-like first contact portion 160*a* provided on the main body side contact member 160. At this time, the shutter 151 is regulated in the moving direction by the guide bosses 153 and the L-shaped slits 151*c*, and is moved in a second direction H.

Figure 16C:
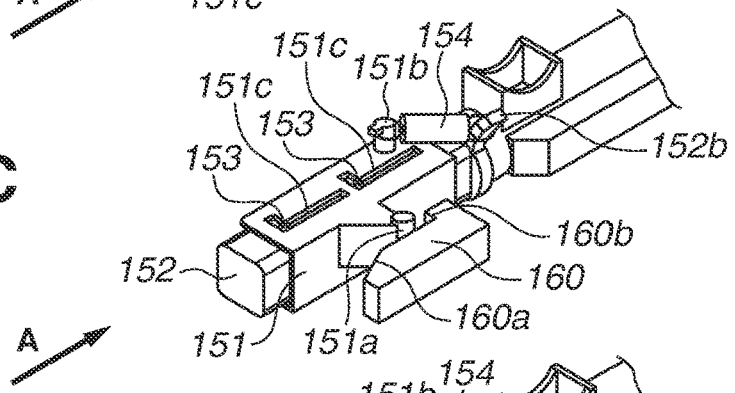
Figure 17C:
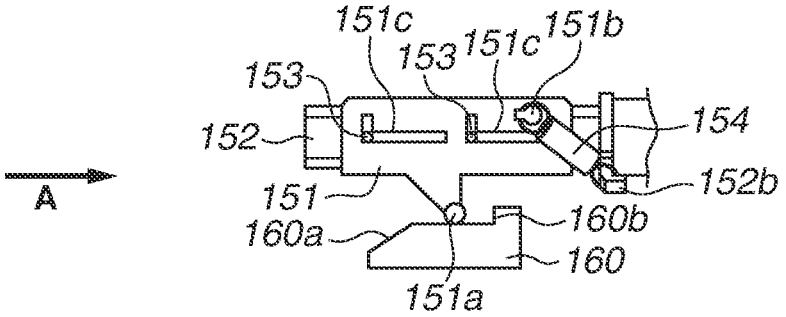
Figure 18C:
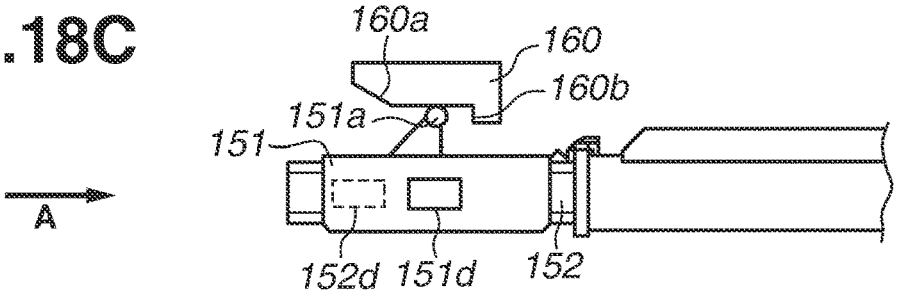

In the state illustrated in FIGS. 16C, 17C, and 18C, the contact portion 151*a* of the shutter 151 has come into contact with the first contact portion 160*a* of the main body side contact member 160, and the guide bosses 153 reach the bent (edge) portions of the L-shaped slits 151*c*. At the bent (edge) portions, the direction of the regulation given to the shutter 151 by the guide bosses 153 is changed.

Figure 16D:
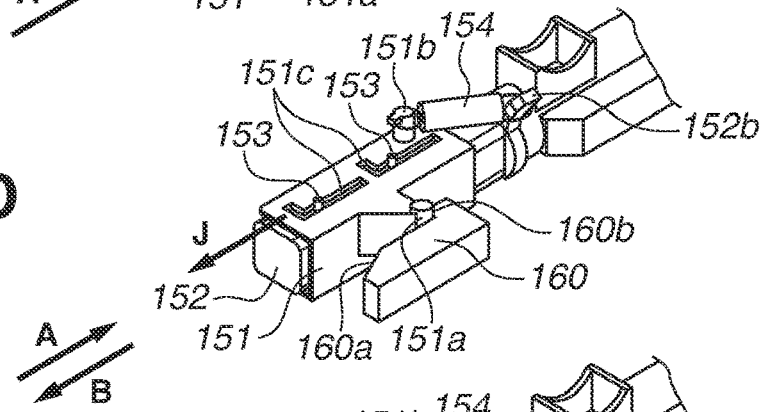
Figure 17D:
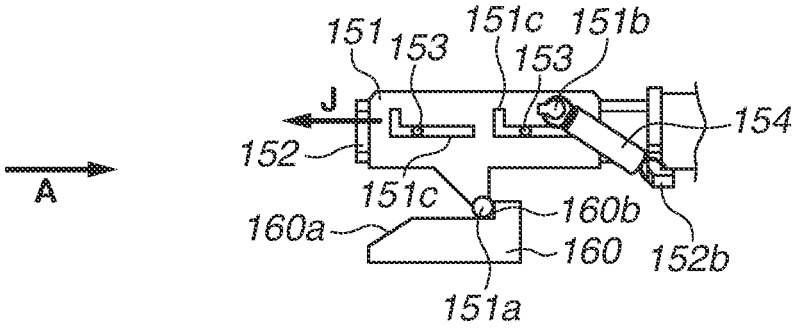
Figure 18D:
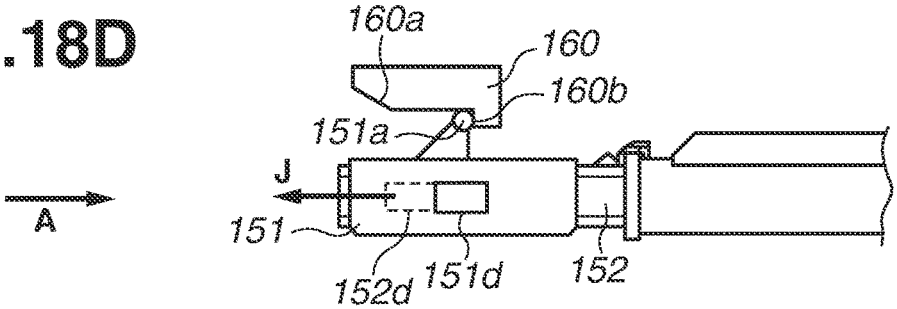

In the state illustrated in FIGS. 16D, 17D, and 18D, the contact portion 151*a* of the shutter 151 comes into contact with the second contact portion 160*b* of the main body side contact member 160, and the shutter 151 moves in a first direction J (identical to the direction B).

Figure 16E:
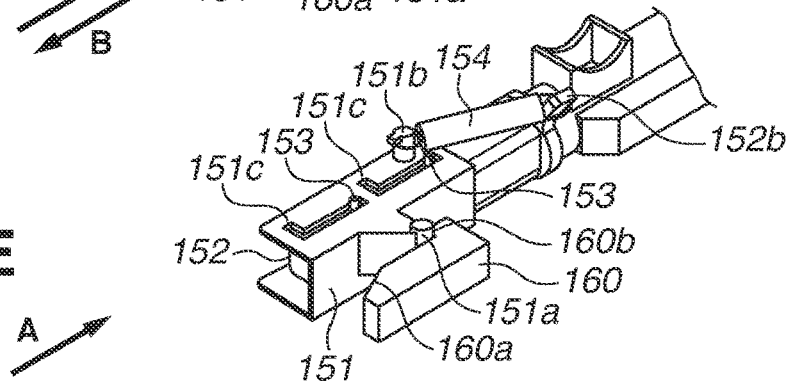
Figure 17E:
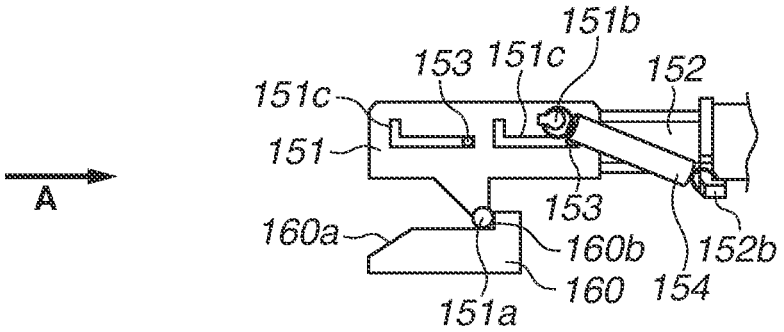
Figure 18E:
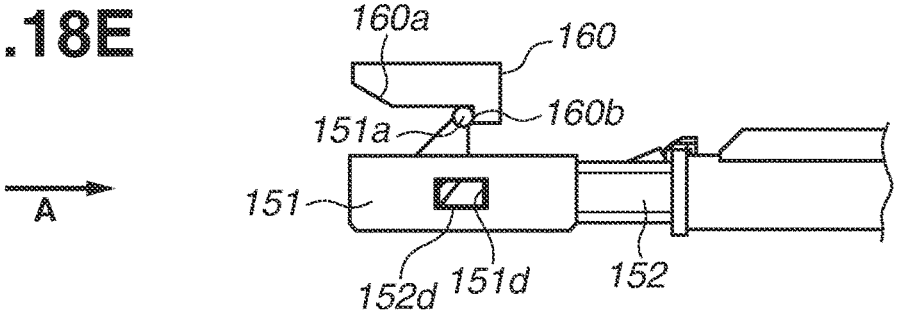

In the state illustrated in FIGS. 16E, 17E, and 18E, attachment of the unit 140 to the apparatus main body is completed, and the shutter 151 reaches the "Opened Position" where the opening 151*d* of the shutter 151 and the bottom opening 152*d* of the toner conveyance pipe 152 communicate with each other.

As described above, the urging force of the tension spring 154 is constantly applied to the shutter 151 toward the "Closed Position". Therefore, when the unit 140 is detached from the apparatus main body, the shutter 51 moves stepwise in the direction opposite to the direction when the unit 40 is attached. Accordingly, the shutter 51 moves from the "Opened Position" to the "Closed Position".

According to the present exemplary embodiment, like the above-described first exemplary embodiment, the shutter 151 moves stepwise in the second direction H and then in the first direction JIB (refers to FIGS. 16B and 16D). Accordingly, the shutter 151 makes a state transition from the "Closed Position" illustrated in FIGS. 16A, 17A, and 18A to the "Opened Position" illustrated in FIGS. 16E, 17E, and 18E. Therefore, similar effects to those of the above-described first exemplary embodiment can also be obtained in the present exemplary embodiment.

The unit 40 and the main body side contact member 60 according to the above-described second exemplary embodiment may also be applicable to the present exemplary embodiment. In this case, the opening and closing operation of the shutter 151 according to present exemplary embodiment can be associated with the opening and closing operation of the door 130, so that similar effects to those of the above-described second exemplary embodiment can be obtained.

A fourth exemplary embodiment of the present disclosure will be described below with reference to FIGS. 19A to 19E, 20A to 20E, and 21A to 21E.

The configuration of the fourth exemplary embodiment is basically similar to the configuration of the first exemplary embodiment (refers to FIGS. 8A to 8C, 9A to 9C, and 10A to 10C) and provides similar effects. Differences of the fourth exemplary embodiment from the first exemplary embodiment will be described below. Configurations similar to those according to the first exemplary embodiment are assigned the same reference numerals.

FIGS. 19A to 19E are perspective conceptual views, viewed from above, illustrating operations of the shutter mechanism of the image forming apparatus according to the fourth exemplary embodiment of the present disclosure. FIGS. 20A to 20E are top conceptual views illustrating operations of the shutter mechanism according to the fourth exemplary embodiment of the present disclosure. FIGS. 21A to 21E are bottom plan views illustrating operations of the shutter mechanism according to the fourth exemplary embodiment of the present disclosure.

More specifically, FIGS. 19A to 19E, 20A to 20E, and 21A to 21E illustrate the vicinities of a shutter 251, viewed from different angles, when the cartridge tray unit is attached to the main body of the image forming apparatus 100. FIGS. 19A, 19B, 19C, 19D, and 19E illustrate a time-sequential state transition in this order (this also applies to FIGS. 20A to 20E and FIGS. 21A to 21E).

According to the present exemplary embodiment, the shapes of the contact portions of the shutter 151 and the main body side contact member 160 according to the above-described third exemplary embodiment are exchanged. Further, the shutter 151 according to the above-described third exemplary embodiment is replaced with a shutter 251 having a first contact portion 251*e* and a second contact portion 251*f*. The main body side contact member 160 is replaced with a main body side contact member 260 having a contact portion 260*a*.

The toner conveyance pipe 152, the guide bosses 153, the tension spring 154, and other portions (not illustrated), except for the shutter and the contact member, are similar to those according to the above-described third exemplary embodiment. A spring hook portion 251*b*, L-shaped slits 251*c*, and an opening 251*d* of the shutter 251 basically have similar shapes to those of the equivalent components of the shutter 151 according to the above-described third exemplary embodiment. The arrangements of these portions are similar to those according to the above-described third exemplary embodiment.

The movement of the shutter 251 in the process of attaching the cartridge tray unit according to the present exemplary embodiment to the apparatus main body in the direction A will be described below with reference to FIGS. 19A to 19E, 20A to 20E, and 21A to 21E.

Figure 19A:
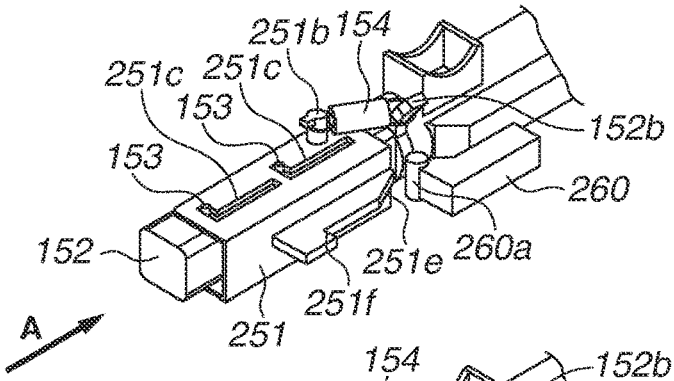
FIGS. 19A to 19E are perspective conceptual views, viewed from above, illustrating operations of a shutter mechanism of an image forming apparatus according to a fourth exemplary embodiment of the present disclosure.
Figure 20A:
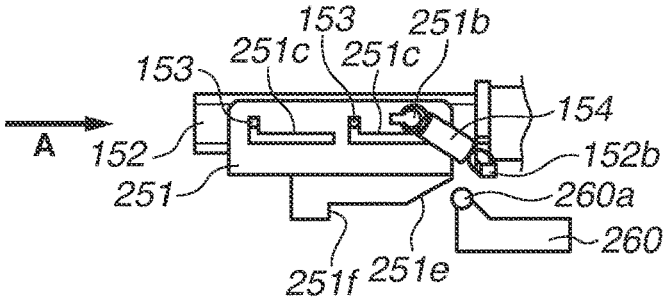
FIGS. 20A to 20E are top conceptual views illustrating operations of the shutter mechanism according to the fourth exemplary embodiment of the present disclosure.
Figure 21A:
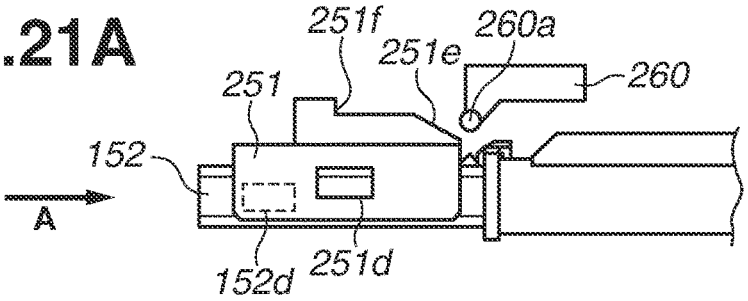
FIGS. 21A to 21E are bottom plan views illustrating operations of the shutter mechanism according to the fourth exemplary embodiment of the present disclosure.

In the state illustrated in FIGS. 19A, 20A, and 21A, the first contact portion 251*e* and the second contact portion 251*f* of the shutter 251 are separated from the main body side contact member 260, and the shutter 251 is in the "Closed Position".

Figure 19B:
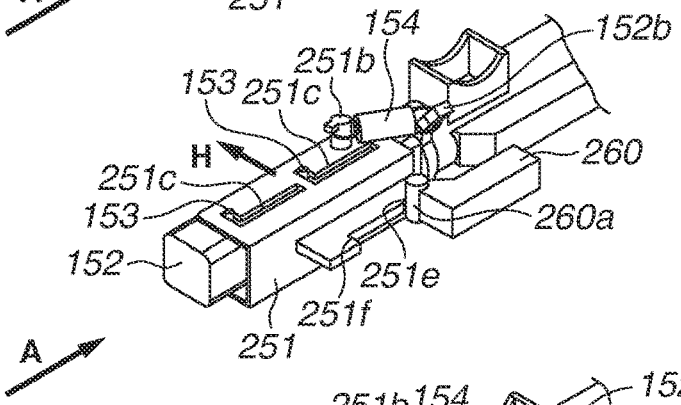
Figure 20B:
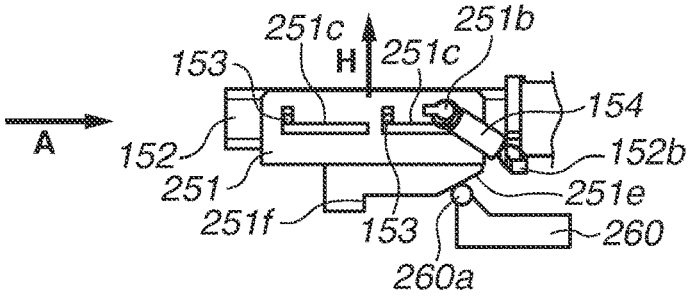
Figure 21B:
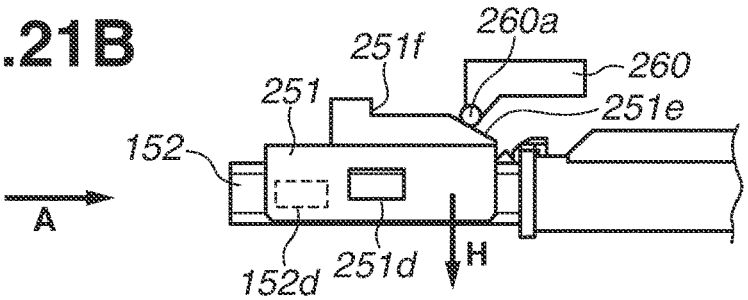

In the state illustrated in FIGS. 19B, 20B, and 21B, the slope-like first contact portion 251*e* on the shutter 251 comes into contact with the contact portion 260*a* on the main body side contact member 260. At this time, the shutter 251 is regulated in the moving direction, by the guide bosses 153 and the L-shaped slits 251*c*, and moves in the second direction H.

Figure 19C:
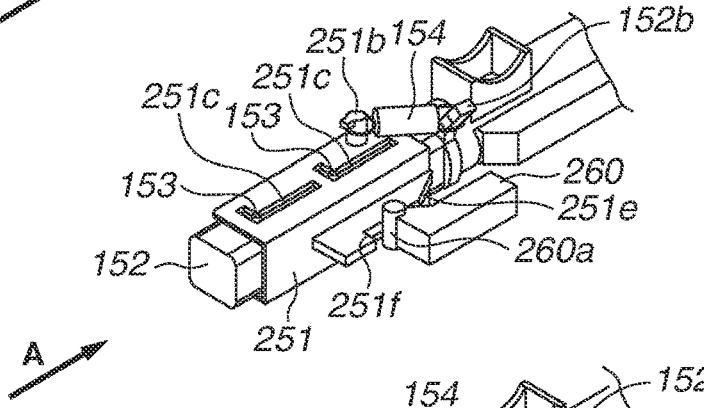
Figure 20C:
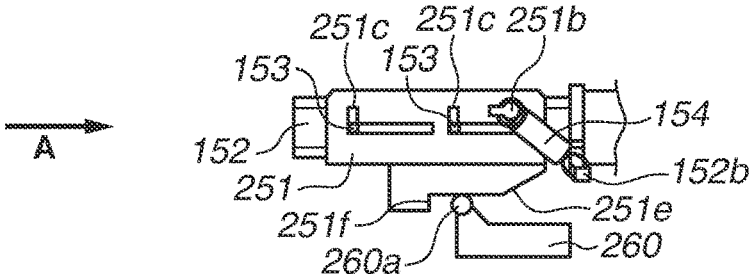
Figure 21C:
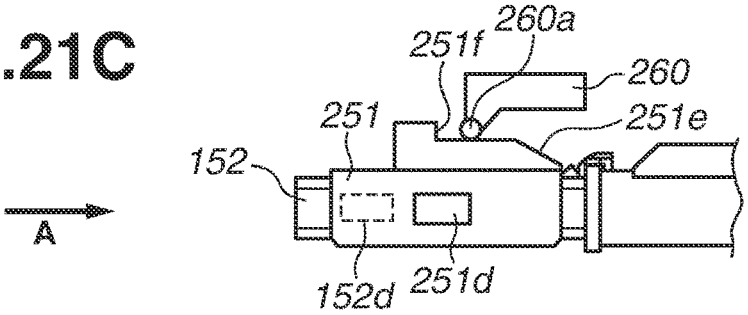

In the state illustrated in FIGS. 19C, 20C, and 21C, the first contact portion 251*e* of the shutter 251 has come into contact with the contact portion 260*a* of the main body side contact member 260, and the guide bosses 153 reach the bent (edge) portions of the L-shaped slits 251*c*. At the bent (edge) portions, the direction of the regulation given to the shutter 251 by the guide bosses 153 is changed.

Figure 19D:
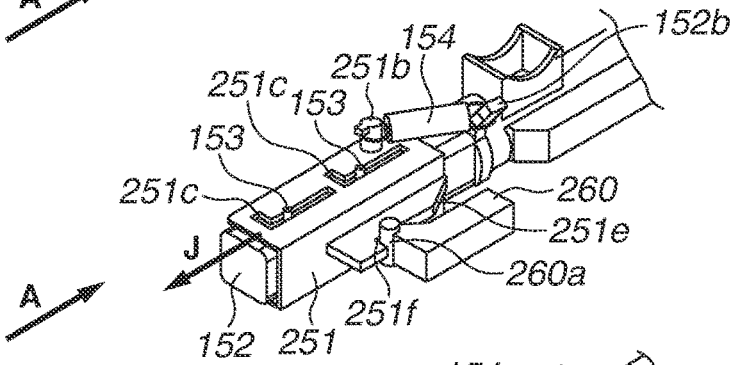
Figure 20D:
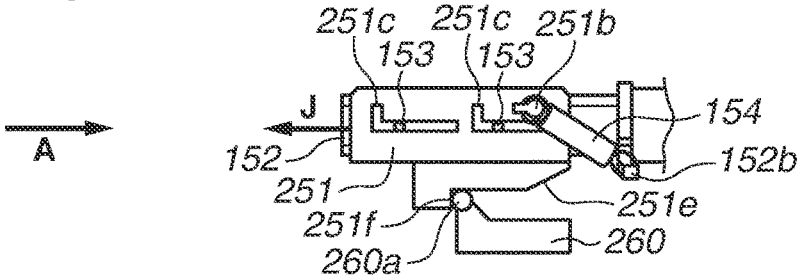
Figure 21D:
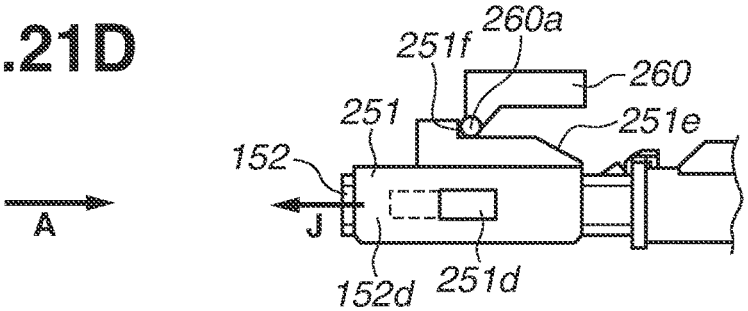

In the state illustrated in FIGS. 19D, 20D, and 21D, the second contact portion 251*f* of the shutter 251 comes into contact with the contact portion 260*a* on the main body side contact member 260, and therefore the shutter 251 moves in the first direction J/B.

Figure 19E:
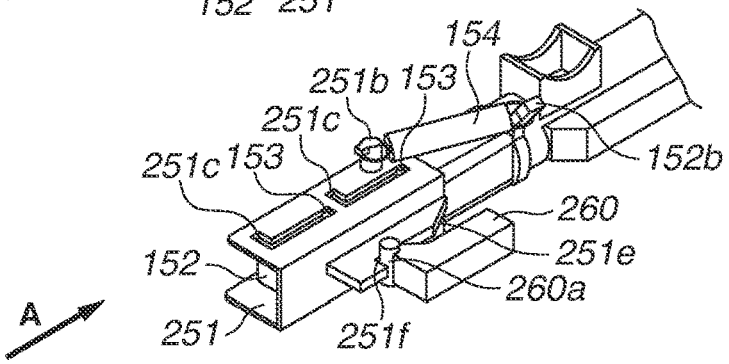
Figure 20E:
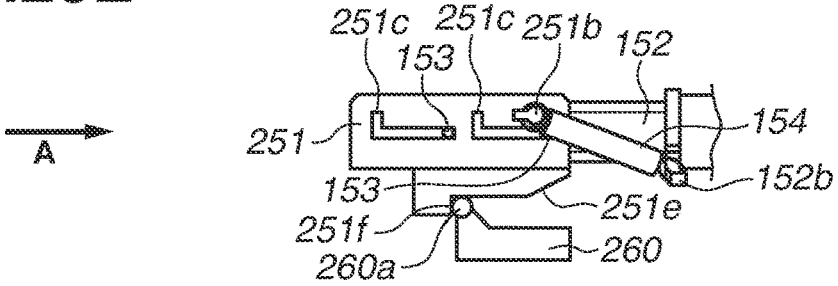
Figure 21E:
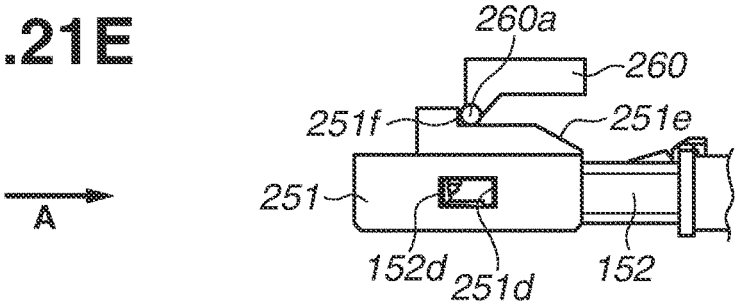

In the state illustrated in FIGS. 19E, 20E, and 21E, attachment of the cartridge tray unit to the apparatus main body is completed, and the shutter 251 reaches the "Opened Position" where the opening 251*d* of the shutter 251 and the bottom opening 152*d* of the toner conveyance pipe 152 communicate with each other.

Like the above-described third exemplary embodiment, the urging force of the tension spring 154 is constantly applied to the shutter 251 toward the "Closed Position". Therefore, when the unit 40 is detached from the apparatus main body, the shutter 251 moves stepwise in the direction opposite to the direction when the unit 40 is attached. Accordingly, the shutter 251 moves from the "Opened Position" to the "Closed Position".

According to the present exemplary embodiment, like the above-described third exemplary embodiment, the shutter 251 moves stepwise in the second direction H and then in the first direction J/B (refers to FIGS. 19B and 19D). Thus, the shutter 251 makes a state transition from the "Closed Position" illustrated in FIGS. 19A, 20A, and 21A to the "Opened Position" illustrated in FIGS. 19E, 20E, and 21E. Therefore, similar effects to those of the above-described third exemplary embodiment can be obtained in the present exemplary embodiment.

The unit 40 and the main body side contact member 60 according to the above-described second exemplary embodiment may also be applicable to the present exemplary embodiment. In this case, since the opening and closing operation of the shutter 251 according to present exemplary embodiment can be associated with the opening and closing operation of the door 130, similar effects to those of the above-described second exemplary embodiment can be obtained.

Exemplary embodiments have been described above with respect to a cartridge tray unit for conveying residual transfer toner and delivering it to a toner collecting container as an example of an attachment/detachment unit (moving unit) provided with an opening for delivering toner and configured to be attached to and detached from the apparatus main body. However, the present disclosure is not limited thereto, and is applicable to moving units attachable to and detachable from (movable relative to) the apparatus main body, such as a toner supply vessel, a toner collecting container, and a belt cleaning unit. More specifically, the present disclosure can be generally applied to attachment/ detachment units (moving units) provided with an opening for delivering toner (discharging toner to or receiving toner from) and configured to be attached to and detached from (movable relative to) the apparatus main body.

The configuration of the present disclosure can be summarized as follows: (1) The moving unit of the present disclosure includes a delivery member 52 provided with an opening 52*d* and configured to deliver a developer through the opening, and a shutter member 51 disposed on the delivery member configured to be movable relative to the delivery member and to change between an opened state S1 where the opening is opened and a closed state S2 where the opening is closed with the shutter member 51. The moving unit is reciprocally movable between a first position P1 and a second position P2 in a first direction connecting the first and the second positions. The first position is a position where the moving unit connects the apparatus main body 100A of the image forming apparatus 100 to deliver the developer to or from the apparatus main body, and the second position is a position where the moving unit does not connect the apparatus main body.

The shutter member is provided with a first contact portion 51*a*1 that can receive a force in a predetermined direction F1/F11 when the shutter member contacts the apparatus main body, and a second contact portion 51*a*2 that can receive a force in a direction F2 different from the predetermined direction when the shutter member contacts the apparatus main body. When the moving unit is moved from the second position P2 to the first position P1 along the first direction A, the first contact portion 51*a*1 and the second contact portion 51*a*2 sequentially come into contact with the apparatus main body 100A/60. Thus, the shutter member moves relative to the delivery member in the second direction E intersecting the first direction and then in the first direction B/G, and the opening changes from the closed state S2 to the open state S1.

The above-described configuration (1) enables preventing the shutter member from being opened in an careless operation, and the shutter member can be opened in a simple configuration when the moving unit is attached to the apparatus main body.

(2) According to the moving unit of the present disclosure, the delivery member 52 can be provided with a biasing member 54 for biasing the shutter member 51 to the position of the closed state S2. Thus, the state where the shutter member 51 closes the opening can be set as the initial state (home position), making it possible to reduce leakage of the developer.

(3) According to the moving unit of the present disclosure, the delivery member 52 can be provided with a first engaging guide member for guiding the movement of the shutter member 51, and the shutter member 51 can be provided with a second engaging guide member 51*c* that can engage with the first engaging guide member 53. This enables stable relative movement between the shutter member and the delivery member.

(4) According to the moving unit of the present disclosure, the first engaging guide member 53 can be formed of a protrusion, and the second engaging guide member 51*c* can be formed of a groove into which the protrusion can fit. This enables stable relative movement between the shutter member and the delivery member in a simple configuration.

(5) According to the moving unit of the present disclosure, the second engaging guide member can be an L-shaped groove. This enables stable relative movement between the shutter member and the delivery member.

(6) According to the moving unit of the present disclosure, the first direction A/B and the second direction E can perpendicularly intersect each other. This enables stable relative movement between the shutter member and the delivery member.

(7) According to the moving unit of the present disclosure, the delivery member 52 can be provided with a conveyance member 56 for conveying the developer to the opening side. Thus, the developer can be efficiently conveyed to the opening side and can be discharged from the opening.

(8) According to the moving unit of the present disclosure, the first contact portion 51*a*1 can be provided with a sliding portion 51*a*3 which is slidable in the apparatus main body when the shutter member moves relative to the delivery member in the second direction. This enables stable relative movement between the shutter member and the delivery member.

(9) The moving unit according to the present disclosure is attachable to and detachable from the main body of the image forming apparatus. The direction of the attachment of the moving unit to the apparatus main body can be the moving direction A from the second to the first position in the first direction A/B. The direction of the detachment of the moving unit from the apparatus main body can be the moving direction B from the first to the second position in the first direction A/B.

(10) According to the moving unit of the present disclosure, at least a part of the delivery member 52 provided with the opening 52*d*, and at least a part of the shutter member 51 covering the opening from the outside are cylindrically formed. The first direction A/B can be a direction along the axis direction of the cylindrical form, and the second direction E can be a direction along the circumferential direction of the cylindrical form.

(11) The image forming apparatus of the present disclosure includes an apparatus main body 100A, and a moving unit 40. The moving unit 40 includes the delivery member 52 provided with the opening 52*d* and configured to deliver the developer through the opening, and the shutter member 51 disposed on the delivery member to be movable relative to the delivery member. The moving unit 40 is reciprocally movable between the first position P1 and the second position P2 in the first direction A/B connecting the first and the second positions. The first position P1 is a position where the moving unit connects with the main body of the image forming apparatus to deliver the developer to or from the apparatus main body, and the second position P2 is a position where the moving unit does not connect with the apparatus main body.

The moving unit 40 is configured to mount a cartridge 4 used for the apparatus main body. The shutter member 51 can change between the open state S1 where the opening is opened and the closed state S2 where the opening is closed with the shutter member 51. The shutter member 51 is provided with the first contact portion 51*a*1 that can receive a force in a predetermined direction F1/F11 when the shutter member 51 contacts the apparatus main body, and the second contact portion 51*a*2 that can receive a force in the direction F2 different from the predetermined direction when the shutter member 51 contacts the apparatus main body. The apparatus main body is provided with a first main body contact portion 60*a* which contacts the first contact portion 51*a*1 to apply a force in a predetermined direction to the first contact portion 51*a*1, and a second main body contact portion 60*b* which contacts the second contact portion 51*a*2 to apply a force in a different direction to the second contact portion 51*a*2. When the moving unit is moved from the second position P2 to the first position Pb along the first direction, the first contact portion 51*a*1 and the second contact portion 51*a*2 sequentially come into contact with the first main body contact portion 60*a* and the second main body contact portion 60*b* of the apparatus main body. Thus, the shutter member moves relative to the delivery member in the second direction E intersecting the first direction A and then in the first direction B/G, and the opening changes from the closed state S2 to the opened state S1.

(12) According to the image forming apparatus of the present disclosure, the first contact portion 51*a*1 and the second contact portion 51*a*2 may be configured to be moved by the movement of the moving unit in the first direction A to come into contact with the first main body contact portion 60*a* and second main body contact portion 60*b*, respectively.

(13) According to the image forming apparatus of the present disclosure, the apparatus main body 100A can be provided with a tray opening 30A for allowing passage of the moving unit that moves in the first direction A, and a door 30 for opening and closing the tray opening 30A. The apparatus main body can also be provided with a link mechanism 600 which is movable between the first contact portion 51*a*1 and the second contact portion 51*a*2 in association with an opening and closing operation of the door.

(14) According to the image forming apparatus of the present disclosure, the moving unit is attachable to and detachable from the main body of the image forming apparatus. The direction of the attachment of the moving unit to the apparatus main body can be the moving direction A from the second to the first position in the first direction A/B. The direction of the detachment of the moving unit from the apparatus main body can be the moving direction B from the first to the second position in the first direction A/B.

The moving unit or the image forming apparatus of the present disclosure enables preventing the shutter member from being opened in a careless operation, and the shutter member can be opened in a simple configuration when the moving unit is attached to the apparatus main body.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-140188, filed Jul. 30, 2019, which is hereby incorporated by reference herein in its entirety.

What is claimed is:

1. A moving unit comprising:

a delivery member provided with an opening and configured to deliver a developer through the opening; and a shutter member provided on the delivery member to be movable relative to the delivery member and configured to change between an open state where the opening is opened and a closed state where the opening is closed with the shutter member, wherein the moving unit is reciprocally movable between a first position and a second position in a first direction connecting the first and second positions, the first position being a position where the moving unit connects with an apparatus main body of an image forming apparatus to deliver the developer to or from the apparatus main body, and the second position being a position where the moving unit does not connect with the apparatus main body, wherein the shutter member is provided with a first contact portion configured to receive a force in a predetermined direction when the shutter member comes into contact with the apparatus main body, and a second contact portion configured to receive a force in a direction different from the predetermined direction when the shutter member comes into contact with the apparatus main body, and wherein, when the moving unit is moved from the second position to the first position along the first direction, the first and second contact portions sequentially come into contact with the apparatus main body, such that the shutter member moves relative to the delivery member in the order of a second direction intersecting the first direction, and the first direction, and the opening changes from the closed state to the open state.

2. The moving unit according to claim 1, wherein the delivery member is provided with a biasing member for biasing the shutter member toward the position of the closed state.

3. The moving unit according to claim 1, wherein the delivery member is provided with a first engaging guide member for guiding the movement of the shutter member, and wherein the shutter member is provided with a second engaging guide member engageable with the first engaging guide member.

4. The moving unit according to claim 3, wherein the first engaging guide member is formed of a protrusion, and wherein the second engaging guide member is formed of a groove into which the protrusion fits.

5. The moving unit according to claim 4, wherein the second engaging guide member is an L-shaped groove.

6. The moving unit according to claim 1, wherein the first direction perpendicularly intersects the second direction.

7. The moving unit according to claim 1, wherein the delivery member is provided with a conveyance member for conveying the developer to the opening side.

8. The moving unit according to claim 1, wherein the first contact portion is provided with a sliding portion slidable in the apparatus main body when the shutter member moves relative to the delivery member in the second direction.

9. The moving unit according to claim 1, wherein the moving unit is attachable to and detachable from the apparatus main body of the image forming apparatus, wherein a direction of attachment of the moving unit to the apparatus main body is a direction of the movement from the second position to the first position in the first direction, and wherein a direction of detachment of the moving unit from the apparatus main body is a direction of the movement from the first position to the second position in the first direction.

10. The moving unit according to claim 1, wherein at least a part of the delivery member provided with the opening, and at least a part of the shutter member covering the opening from the outside are cylindrically formed, wherein the first direction is a direction along an axis direction of the cylindrical form, and wherein the second direction is the direction along a circumferential direction of the cylindrical form.

11. An image forming apparatus comprising:

an apparatus main body; and a moving unit comprising a delivery member provided with an opening and configured to deliver a developer through the opening, and a shutter member provided on the delivery member to be movable relative to the delivery member and configured to change between an open state where the opening is opened and a closed state where the opening is closed with the shutter member, wherein the moving unit is configured to mount a cartridge used for the apparatus main body, and is reciprocally movable between a first position and a second position in a first direction connecting the first and second positions, the first position being a position where the moving unit connects with the apparatus main body of the image forming apparatus to deliver the developer to or from the apparatus main body, and the second position being a position where the moving unit does not connect with the apparatus main body, wherein the shutter member is provided with a first contact portion configured to receive a force in a predetermined direction when the shutter member comes into contact with the apparatus main body, and a second contact portion configured to receive a force in a direction different from the predetermined direction when the shutter member comes into contact with the apparatus main body, wherein the apparatus main body is provided with a first main body contact portion which contacts the first contact portion to apply a force in the predetermined direction to the first contact portion, and a second main body contact portion which contacts the second contact portion to apply the force in a different direction to the second contact portion, and wherein, when the moving unit is moved from the second position to the first position along the first direction, the first and second contact portions sequentially come into contact with the first and the second main body contact portions of the apparatus main body, respectively, such that the shutter member moves relative to the delivery member in the order of a second direction intersecting the first direction, and the first direction, and the opening changes from the closed state to the open state.

12. The image forming apparatus according to claim 11, wherein the first and second contact portions are moved by the movement of the moving unit in the first direction to come into contact with the first and second main body contact portions, respectively.

13. The image forming apparatus according to claim 11, wherein the apparatus main body comprises:

a tray opening configured to allow passage of the moving unit that moves in the first direction;

a door configured to open and close the tray opening; and a link mechanism configured to move the first and second contact portions in association with an opening and closing operation of the door.

14. The image forming apparatus according to claim 11, wherein the moving unit is attachable to and detachable from the apparatus main body of the image forming apparatus, wherein a direction of attachment of the moving unit to the apparatus main body is a direction of the movement from the second position to the first position in the first direction, and wherein a direction of detachment of the moving unit from the apparatus main body is a direction of the movement from the first position to the second position in the first direction.

* * * * *